US007880121B2

(12) United States Patent
Naylor

(10) Patent No.: US 7,880,121 B2
(45) Date of Patent: Feb. 1, 2011

(54) MODULAR RADIANT HEATING APPARATUS

(76) Inventor: David Naylor, 1141 E. Old Dairy Rd., Sandy, UT (US) 84094

( * ) Notice: Subject to any disclaimer, the term of this patent is extended or adjusted under 35 U.S.C. 154(b) by 394 days.

(21) Appl. No.: 11/422,580

(22) Filed: Jun. 6, 2006

(65) Prior Publication Data

US 2006/0289000 A1 Dec. 28, 2006

Related U.S. Application Data

(63) Continuation-in-part of application No. 11/218,156, filed on Sep. 1, 2005, now Pat. No. 7,230,213, and a continuation-in-part of application No. 11/344,830, filed on Feb. 1, 2006, now Pat. No. 7,183,524.

(60) Provisional application No. 60/688,146, filed on Jun. 6, 2005, provisional application No. 60/654,702, filed on Feb. 17, 2005, provisional application No. 60/656,060, filed on Feb. 23, 2005, provisional application No. 60/688,146, filed on Jun. 6, 2005.

(51) Int. Cl.
*H05B 1/00* (2006.01)

(52) U.S. Cl. ..... 219/213; 219/200

(58) Field of Classification Search ..... 219/211, 219/212, 213, 217, 527, 528, 529, 542, 543, 219/549, 545, 544; 338/22 R; 428/407, 428/408

See application file for complete search history.

(56) References Cited

U.S. PATENT DOCUMENTS

| | | | | |
|---|---|---|---|---|
| 1,455,287 | A | 5/1923 | Hadley | |
| 1,486,412 | A | 3/1924 | Biddlecom | |
| 2,666,840 | A | 1/1954 | Poirier | |
| 2,745,942 | A * | 5/1956 | Cohen | 219/528 |
| 3,380,087 | A | 4/1968 | Petty et al. | |
| 3,417,229 | A | 12/1968 | Shomphe et al. | 219/528 |
| 3,510,547 | A | 5/1970 | Eisler | 264/33 |
| 3,649,725 | A | 3/1972 | Olson | 264/40 |
| 3,659,077 | A | 4/1972 | Olson | 219/213 |
| 3,694,622 | A * | 9/1972 | Bentley | 219/213 |

(Continued)

FOREIGN PATENT DOCUMENTS

| | | |
|---|---|---|
| JP | 04350257 | 12/1992 |

(Continued)

OTHER PUBLICATIONS

"Thawzall Heater" http://www.themachinecompany.com/faq.htm.

(Continued)

*Primary Examiner*—Thor S Campbell
(74) *Attorney, Agent, or Firm*—Workman Nydegger

(57) ABSTRACT

An apparatus, system, and method provide radiant heat. A planar electrical heating element converts electrical energy to heat energy. A planar heat spreading layer is in contact with the planar electrical heating element, drawing the heat energy out of the planar electrical heating element and distributing the heat energy. A finishing layer is disposed to one side of the planar heat spreading layer. A thermal isolation layer is disposed to an opposite side of the planar heat spreading layer as the finishing layer. Heat from the planar heat spreading layer conducts away from the thermal isolation layer and toward the finishing layer. An electric power coupling is connected to the electrical heating element to supply electrical power.

26 Claims, 10 Drawing Sheets

U.S. PATENT DOCUMENTS 3,729,614 A 4/1973 Martinet ..... 219/345
3,812,320 A 5/1974 Borgren ..... 219/213
3,868,825 A 3/1975 Boyce ..... 61/36
3,897,928 A 8/1975 Eisler ..... 249/78
3,968,348 A 7/1976 Stanfield
3,988,791 A 11/1976 Simon
4,000,815 A 1/1977 Wingbro et al.
4,060,710 A * 11/1977 Reuter et al. ..... 219/548
4,091,266 A 5/1978 Ito et al. ..... 219/504
4,238,105 A 12/1980 West ..... 249/78
4,244,411 A 1/1981 Karlstrom et al.
4,316,080 A 2/1982 Wroblewski ..... 219/505
4,423,694 A 1/1984 Senneville ..... 112/405
4,457,491 A 7/1984 Dudman ..... 251/317
4,485,297 A 11/1984 Grise et al.
4,607,154 A 8/1986 Mills ..... 219/505
4,832,881 A * 5/1989 Arnold et al. ..... 264/29.7
4,899,031 A 2/1990 Dyer ..... 219/213
4,935,602 A 6/1990 Bravo
4,967,057 A * 10/1990 Bayless et al. ..... 219/213
5,181,006 A * 1/1993 Shafe et al. ..... 338/22 R
5,198,063 A 3/1993 Howard
5,371,340 A * 12/1994 Stanfield ..... 219/217
5,550,350 A * 8/1996 Barnes ..... 219/213
5,590,478 A 1/1997 Furness ..... 34/437
5,614,292 A * 3/1997 Saylor ..... 428/209
5,780,367 A 7/1998 Handwerker ..... 442/235
5,824,996 A 10/1998 Kochman et al. ..... 219/529
5,827,050 A 10/1998 Price
5,830,809 A 11/1998 Howard
5,974,830 A 11/1999 Boyd
5,986,243 A 11/1999 Campf
6,051,811 A 4/2000 Hardison ..... 219/213
6,051,812 A * 4/2000 Walker ..... 219/213
6,057,530 A 5/2000 Gurevich ..... 219/529
6,160,246 A 12/2000 Rock et al.
6,184,496 B1 2/2001 Pearce ..... 219/213
6,189,487 B1 * 2/2001 Owen et al. ..... 119/28.5
6,211,493 B1 * 4/2001 Bouman ..... 219/213
6,245,400 B1 6/2001 Tzeng
6,279,856 B1 8/2001 Rutherford et al. ..... 244/134
6,294,768 B1 * 9/2001 Liebich ..... 219/528
6,303,905 B1 * 10/2001 Chiles et al. ..... 219/213
6,330,986 B1 12/2001 Rutherford et al. ..... 244/134
6,330,988 B1 12/2001 Liu et al. ..... 244/134
6,392,209 B1 5/2002 Oppitz ..... 219/549
6,426,488 B2 7/2002 Schielke ..... 219/505
6,426,489 B1 * 7/2002 Elsasser ..... 219/543
6,432,336 B1 8/2002 Mercuri
6,482,520 B1 11/2002 Tzeng
6,483,087 B2 11/2002 Gardner et al. ..... 219/545
6,503,626 B1 1/2003 Norley
6,631,603 B2 * 10/2003 Zornes ..... 52/782.1
6,657,170 B2 12/2003 Clothier ..... 219/622
6,664,520 B2 12/2003 Clothier ..... 219/634
6,667,100 B2 12/2003 Rutherford et al. ..... 428/408
6,673,284 B2 1/2004 Mercuri
6,673,289 B2 1/2004 Reynolds, III et al. ..... 264/115
6,740,381 B2 * 5/2004 Day et al. ..... 428/56
6,746,768 B2 6/2004 Greinke
6,782,640 B2 * 8/2004 Westin ..... 36/29
6,797,251 B1 * 9/2004 Bennett et al. ..... 423/445 R
6,841,250 B2 1/2005 Tzeng ..... 428/408
6,848,200 B1 * 2/2005 Westin ..... 36/29
6,855,915 B2 * 2/2005 Gehring ..... 219/213
6,886,233 B2 5/2005 Rutherford et al. ..... 29/426.4
6,897,417 B1 * 5/2005 Usselman et al. ..... 219/528
6,943,320 B1 * 9/2005 Bavett ..... 219/213
6,982,874 B2 1/2006 Smalc
7,049,559 B2 5/2006 Ishii et al. ..... 219/549
7,108,055 B2 9/2006 Krassowski
7,161,809 B2 1/2007 Ford
7,166,912 B2 1/2007 Tzeng
7,183,524 B2 2/2007 Naylor
7,186,309 B2 3/2007 Mercuri
7,230,213 B2 * 6/2007 Naylor ..... 219/528
7,232,601 B2 6/2007 Mercuri
7,393,577 B2 * 7/2008 Day et al. ..... 428/121
7,393,587 B2 7/2008 Krassowski
2001/0031350 A1 * 10/2001 Day et al. ..... 428/317.9
2002/0069603 A1 * 6/2002 Zornes ..... 52/612
2002/0164483 A1 * 11/2002 Mercuri et al. ..... 428/408
2003/0046831 A1 * 3/2003 Westin ..... 36/29
2003/0085215 A1 5/2003 Rix
2004/0035853 A1 2/2004 Pais
2004/0221529 A1 * 11/2004 Zornes ..... 52/311.1
2005/0074593 A1 * 4/2005 Day et al. ..... 428/292.1
2006/0191902 A1 8/2006 Naylor
2006/0191903 A1 8/2006 Naylor et al.
2006/0289000 A1 12/2006 Naylor
2006/0289468 A1 12/2006 Seibert et al.
2007/0262073 A1 11/2007 Naylor

FOREIGN PATENT DOCUMENTS

JP 06129095 5/1994
JP 2001123667 5/2001

OTHER PUBLICATIONS

"Q Foil Performance" http://www.rotabolt.com/html/qfoil_1.html.
"Q Foil Technology" http://www.rotabolt.com/html/qfoil.html.
"Q Foil Product Features" http://www.rotabolt.com/html/qfoil_2.html.
"Thawzall Product Selection" http://www.themachinecompany.com/products.htm.
"Ground Heaters S3000" http://www.groundheaters.com/s3000.htm.
"How It Works" http://www.groundheaters.com/how_it_works.htm.
"GrafTech" http://www.graphtech.com.
"FP Parallel Constant Watt Heating Cable" Thermon Manufacturing Co.
"SCS Concrete Curing Blankets" http://www.scsincorporated.com/Curingblankets.htm.
"Mauritzon Concrete Curing Blankets" http://www.mauritzononline.com/concretecure.html.
"Concrete-Curing-Blankets.Com" http://concrete-curing-blankets.com/.
"Janell Concrete Curing Methods" http://www.janell.com/engineering_data.html.
"GrafTech Material Safety Data Sheet" May 17, 2005.
Concrete Curing Technology, Inc. "Instructions for Use of Pad".
"GO polymers" http://www.gopolymers.com/index.php?module=abs.
Julian Norley and Gary Chen "GrafTech High Performance, Lightweight Graphite Heat Sinks/Spreaders" IEEE 2002.
Grafoil Flexible Graphite "Typical Grafoil Sheet Properties".
"Springfield Wire, Inc." http://www.springfield-wire.com/category.cfm?Category=21.
Related U.S. Appl. No. 11/835,641, filed Aug. 8, 2007 (Not Yet Published).
Related U.S. Appl. No. 12/119,434, filed May 12, 2008 (Not Yet Published).
"Electric Floor Heating", portion of catalog from Heating Catalog, http://www.wattsradiant.com.
"The Future Looks Radiant", Full Line Radiant Catalog, http://www.wattsradiant.com.
"Hotmesh", various pages from website, http://www.worldscientificdevelopment.com/hotmesh.
"GrafTech Material Safety Data Sheet" May 17, 2005.
Julian Norley and Gary Chen "GrafTech High Performance, Lightweight Graphite Heat Sinks/Spreaders" IEEE 2002.

GrafTech International "Dramatically Improve Your Radiant Floor Heating Performance" Copyright 2008 GrafTech International Holdings Inc. 1 page.
U.S. Appl. No. 11/258,249, filed Oct. 24, 2008.
U.S. Appl. No. 12/212,529, filed Sep. 17, 2008.
U.S. Appl. No. 12/264,460, filed Nov. 4, 2008.
U.S. Appl. No. 12/258,240, filed Oct. 24, 2008.
U.S. Appl. No. 12/264,469, filed Nov. 4, 2008.
U.S. Appl. No. 12/264,480, filed Nov. 4, 2008.
U.S. Appl. No. 12/264,493, filed Nov. 4, 2008.
U.S. Appl. No. 12/260,021, filed Oct. 28, 2008.
U.S. Appl. No. 11/744,163, filed May 3, 2007, Naylor.
U.S. Appl. No. 12/436,905, filed May 7, 2009, Caterina.
Office Action dated Jan. 25, 2006 cited in related Patent No. 7,230,213.
Office Action dated Aug. 28, 2006 cited in related Patent No. 7,230,213.
Notice of Allowance dated Feb. 7, 2007 cited in related Patent No. 7,230,213.
Office Action dated Jun. 22, 2006 cited in related Patent No. 7,183,524.
Notice of Allowance dated Nov. 29, 2006 cited in related Patent No. 7,183,524.
International Search Report from PCT/US05/37414.
Written Opinion from PCT/US05/37414.
International Preliminary Report on Patentability from PCT/US05/37414.
International Search Report from PCT/US06/04437.
Written Opinion from PCT/US06/04437.
International Preliminary Report on Patentability from PCT/US06/04437.
International Search Report from PCT/US08/62481.
Written Opinion from PCT/US08/62481.
International Preliminary Report on Patentability from PCT/US08/62481.
International Search Report from PCT/US08/62479.
Written Opinion from PCT/US08/62479.
International Preliminary Report on Patentability from PCT/US08/62479.
International Search Report from PCT/US09/43443.
Office Action dated Mar. 8, 2010 from U.S. Appl. No. 12/264,469.
Office Action dated Mar. 5, 2010 from U.S. Appl. No. 12/264,493.
Office Action dated Mar. 5, 2010 from U.S. Appl. No. 12/260,021.
Office Action dated Sep. 29, 2010 from U.S. Appl. No. 12/119,434.
Office Action dated Sep. 1, 2010 from U.S. Appl. No. 11/835,641.

* cited by examiner

MODULAR RADIANT HEATING APPARATUS

CROSS-REFERENCES TO RELATED APPLICATIONS

This application claims the benefit of U.S. Provisional Patent Application No. 60/688,146, filed Jun. 6, 2005 entitled "LAMINATE HEATING APPARATUS" which is incorporated herein by reference in its entirety. This application is also a continuation in part of U.S. application Ser. No. 11/218,156 filed Sep. 1, 2005, now U.S. Pat. No. 7,230,213 which claims the benefit of: U.S. Provisional Patent Application 60/654,702 filed on Feb. 17, 2005, titled A MODULAR ACTIVELY HEATED THERMAL COVER U.S. Provisional Patent Application 60/656,060 filed Feb. 23, 2005 titled A MODULAR ACTIVELY HEATED THERMAL COVER; and U.S. Provisional Patent Application 60/688,146 filed Jun. 6, 2005, titled LAMINATE HEATING APPARATUS each of which is incorporated herein by reference in their entireties. This application is also a Continuation in Part of U.S. patent application Ser. No. 11/344,830, filed Feb. 1, 2006, now U.S. Pat. No. 7,183,524 which claims the benefit of: U.S. Provisional Patent Application 60/654,702 filed on Feb. 17, 2005, titled A MODULAR ACTIVELY HEATED THERMAL COVER; U.S. Provisional Patent Application 60/656,060 filed Feb. 23, 2005 titled A MODULAR ACTIVELY HEATED THERMAL COVER and U.S. Provisional Patent Application 60/688,146 filed Jun. 6, 2005, titled LAMINATE HEATING APPARATUS, each of which is incorporated herein by reference in their entireties.

BACKGROUND OF THE INVENTION

1. Field of the Invention

This invention relates to heating apparatuses and particularly to radiant heating apparatuses.

2. Description of the Related Art

Cold, ice, snow, and frost are undesirable in many fields. For example, when concrete is poured, the ground must be thawed and free of snow and frost. In agriculture, planters often plant seeds, bulbs, and the like before the last freeze of the year. Roofs of buildings accumulate snow and ice that must be removed to preserve the integrity of the structure and for other reasons. Homes and other buildings require heating for the comfort and health of occupants. In such examples, it is useful to keep the buildings, roofs, concrete, soil, and other surfaces generally warm and free of ice, snow, and frost.

Standard methods for heating and for removing and preventing ice, snow, and frost include forcing heated air through the rooms or heated water on the surfaces to be heated. Such methods are often expensive, time consuming, inefficient, and otherwise problematic.

Additionally, many situations exist in which a volume of space needs to be heated but existing methods and apparatuses for doing so are problematic. For example, normal ways of heating a residence include forced-air systems or radiant heat systems using heated water or oil that flows through pipes through the walls, floors, or a heating register of a room, with commensurate complications of dryness, moisture, water pipe breakage, and other problems.

Currently, few conventional solutions exist that use electricity to produce and conduct heat. Traditionally, this was due to limited circuit designs, and inefficient management of the electrically produced heat. Traditional solutions were unable to produce sufficient heat over a sufficient surface area to be practical. The traditional solutions that did exist required special electrical circuits with higher voltages that were protected by higher rated breakers than those ordinarily used in a commercial or residential building. These higher voltages and currents are often unavailable at either residential or commercial sites. Thus, using conventional standard circuits, conventional solutions are unable to produce sufficient heat over a sufficiently large surface area to be practical. In addition, specialized electrical circuits for the higher voltages increased the costs of installing such systems and the energy bills for operating the systems.

What is needed is a radiant heating apparatus that operates using electricity from standard residential and commercial power supplies, is cost effective, simple to install, and customizable to provide heated coverage for variable size surfaces efficiently and cost effectively. Thus, an apparatus is needed which overcomes the complexity and limitations of existing systems and provides the benefits of heating without the associated problems.

SUMMARY OF THE INVENTION

The present invention has been developed in response to the present state of the art, and in particular, in response to the problems and needs in the art that have not yet been fully solved by currently available heating solutions. Accordingly, the present invention has been developed to provide a radiant heating apparatus and associated system that overcomes many or all of the above-discussed shortcomings in the art.

A radiant heating apparatus is presented. The radiant heating apparatus may include a planar electrical heating element, a planar heat spreading layer, a finishing layer, a thermal isolation layer, an electric power coupling, a covering layer, a temperature control module, a manual switch, and a sensor.

In one embodiment, the planar electrical heating element converts electrical energy to heat energy. In another embodiment, the planar electrical heating element comprises a plurality of resistive elements that convert electrical energy to heat energy, a thermal reflection layer that reflects heat radiated from the resistive elements back toward the resistive elements, a first separation layer disposed between the thermal reflection layer and the resistive elements to prevent direct contact between the thermal reflection layer and the resistive elements, a second separation layer disposed such that the resistive elements are positioned between the first separation layer and the second separation layer, the second separation layer configured to prevent contact between the resistive elements and a surface in contact with the electrical heating element, and an adhesive disposed between the first separation layer and the second separation layer to conduct thermal energy from the resistive elements to the planar heat spreading layer. In a further embodiment, the planar electrical heating element outputs up to about 8 to 10 watts per foot, and the sum of the lengths of one or more planar electrical heating elements coupled together is less than about 269 feet.

In one embodiment, the planar heat spreading layer is in contact with the planar electrical heating element. The planar heat spreading layer draws heat energy out of the planar electrical heating element and distributes the heat energy. In another embodiment, the planar heat spreading layer comprises a thermally conductive material configured such that thermal conduction is anisotropic, the thermal conduction occurring more readily within a longitudinal plane of the thermally conductive material than perpendicular to the plane of the thermally conductive material. In a further embodiment, the planar heat spreading layer comprises a carbon-based material.

In one embodiment, the finishing layer is disposed to one side of the planar heat spreading layer. In another embodiment, the finishing layer is a flooring layer, a wall layer, a ceiling layer, or a roofing layer. In a further embodiment, the finishing layer is a wall layer and the radiant heating apparatus is disposed within a lower portion of the wall layer, the lower portion extending from a floor to about half of a length of the wall layer. In one embodiment, the finishing layer is a roofing layer, and the roofing layer is positioned below the planar heat spreading layer. In one embodiment, the radiant heating apparatus is sized and shaped to substantially match the size and shape of a finishing layer that is a roofing layer.

In one embodiment, the thermal isolation layer is disposed to an opposite side of the planar heat spreading layer as the finishing layer. This causes heat from the planar heat spreading layer to conduct away from the thermal isolation layer toward the finishing layer.

In one embodiment, the electric power coupling is connected to the electrical heating element to supply electrical power. In another embodiment, the electric power coupling couples a radiant heating apparatus comprising a core radiant heating sheet to one or more radiant heating apparatuses comprising filler radiant heating sheets. The core radiant heating sheet and the filler radiant heating sheets form a single electric circuit having a standard residential voltage and current.

In one embodiment, the covering layer is disposed between the planar heat spreading layer and the finishing layer. The covering layer further distributes heat energy, and provides a prepared surface for the finishing layer.

In one embodiment, the temperature control module regulates the electrical power supplied to the electrical heating element by the electrical power coupling. The temperature control module may turn the electrical power on and off, or set the electrical power to various levels.

In one embodiment, the manual switch controls the electrical power supplied to the electrical heating element by the electrical power coupling. The manual switch may be switched on and off by a user to manipulate the temperature of the electrical heating element.

In one embodiment, the sensor regulates the electrical power supplied to the electrical heating element in response to detecting one of snow and ice accumulation on the finishing layer. In another embodiment, the sensor is a weight sensor. In a further embodiment, the sensor is a precipitation and temperature sensor.

A portable pliable radiant heating apparatus is presented. The portable pliable radiant heating apparatus may include a pliable planar electrical heating element, a pliable planar heat spreading layer, a thermal isolation layer, a top and bottom pliable outer layer, an electric power coupling, a fastener, and a temperature control module.

In one embodiment, the pliable planar electrical heating element is configured to convert electrical energy to heat energy. In another embodiment, the pliable electrical heating element is substantially similar to the planar electrical heating element described above.

In one embodiment the pliable planar heat spreading layer is in contact with the pliable planar electrical heating element. The pliable planar heat spreading layer draws heat energy out of the pliable planar electrical heating element and distributes the heat energy within a longitudinal plane of the pliable planar heat spreading layer. In another embodiment, the pliable planar heat spreading element comprises a thermally conductive material configured such that thermal conduction is anisotropic, the thermal conduction occurring more readily within a longitudinal plane of the thermally conductive material than perpendicular to the plane of the thermally conductive material. In a further embodiment, the thermally conductive material is a layer of carbon-based material deposited between a pair of structural substrates.

In one embodiment the thermal isolation layer is positioned below the pliable planar heat spreading layer. Heat from the planar heat spreading layer conducts away from the thermal isolation layer.

In one embodiment, the top and bottom pliable outer layers are joined to enclose the pliable planar heat spreading layer and the thermal isolation layer. The top and bottom pliable outer layers provide durable protection in an outdoor environment.

In one embodiment, the fastener substantially circumscribes a perimeter around the planar heat spreading layer and the thermal isolation layer. The fastener couples the portable pliable radiant heating apparatus to one or more walls of a portable shelter.

In one embodiment, the temperature control module regulates the electrical power supplied to the pliable planar electrical heating element by the electric power coupling. The temperature control module may include a thermostat or other sensor, and a user interface.

In one embodiment, the portable pliable radiant heating apparatus comprises a floor for a portable shelter. In another embodiment, the portable pliable radiant heating apparatus is positioned below a floor of a portable shelter. In a further embodiment, the portable pliable radiant heating apparatus is positioned above a floor of a portable shelter.

The present invention includes a system for providing radiant heat. The system may include a core radiant heating sheet, one or more filler radiant heating sheets, a finishing layer, a thermal isolation layer, a power supply, and a temperature control module, as described above.

In one embodiment, the core radiant heating sheet and the filler radiant heating sheets are selected from a set of radiant heating sheets, each radiant heating sheet having a predefined size, the core radiant heating sheet and the filler radiant heating sheets coupled electrically to form an electric circuit. The core radiant heating sheet and the filler radiant heating sheets comprise a pliable multilayered heating element configured to convert electrical energy to heat energy, a planar carbon-based heat spreading layer in contact with the pliable multilayered electrical heating element, and an electric power coupling, as described above.

The present invention includes a method of installing a radiant heating apparatus. The method may include bonding an electrical heating tape to a planar carbon-based heat spreading layer, disposing the planar carbon-based heat spreading layer to one side of a thermal isolation layer, coupling the electrical heating tape to a standard residential electric circuit protected by a breaker, and disposing a finishing layer to an opposite side of the planar carbon-based heat spreading layer as the thermal isolation layer.

Embodiments of the present invention may have a variety of shapes and sizes. Examples of sizes include any two dimensional geometric size including square, rectangle, circle, triangle, and the like.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
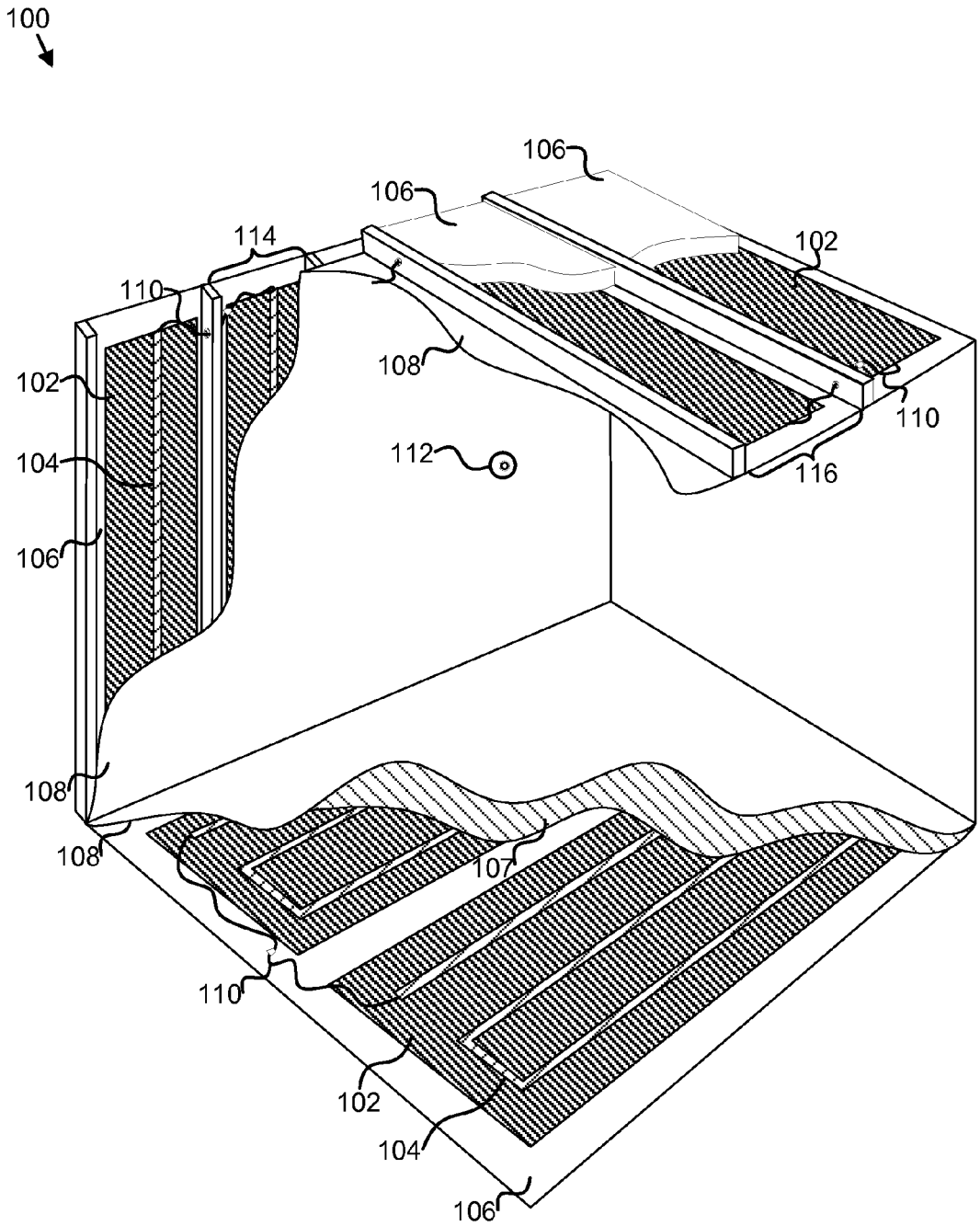
FIG. 1 is a perspective view of one embodiment of a radiant heating apparatus according to one aspect of the invention.

FIG. 1 is a perspective view illustrating several embodiments of a radiant heating system 100 according to the invention. In one embodiment, the radiant heating system 100 is configured to heat the floor, walls, and/or ceiling of a room. The radiant heating apparatus 100 has a heat spreading layer 102, an electrical heating element 104, a thermal isolation layer 106, a finishing layer 108, an electric power coupling 110, and a temperature control module 112.

In one embodiment, the heat spreading layer 102 is a planar layer of material capable of drawing heat from the electrical heating element 104 and distributing the heat energy away from the electrical heating element 104. Specifically, the heat spreading layer 102 may comprise graphite, a composite material, or other substantially planar material. The heat spreading element 102, in one embodiment, comprises a material that is thermally anisotropic. A material is thermally anisotropic if it does not have the same thermal properties in all directions or planes of the material. In one embodiment, the thermal conduction of the heat spreading layer 102 occurs more readily within a longitudinal plane of the heat spreading layer 102 than perpendicular to the plane of the heat spreading layer 102. In this manner, the heat spreading layer 102 quickly spreads heat out away from the heating element 104 to heat up the whole surface area of the heat spreading layer 102 quickly and evenly. Using a thermally anisotropic material for the heat spreading layer 102 distributes the heat energy more evenly and more efficiently, allowing a larger surface area to be heated with minimal power.

In one embodiment, the thermally anisotropic material used is a carbon-based material, like exfoliated graphite, compressed and laminated into a flat sheet. Graphite is made up of carbon atoms arranged in layers lying atop one another, each layer comprising networks of atoms, the layers being bonded together by relatively weak van der Waals forces. The atoms in the layers are arranged in crystallites, the crystallites' size varying from small, in less-ordered graphite materials, to large, in highly ordered graphite materials. In highly ordered graphite materials, moreover, the crystallites are strongly aligned, with a marked preference for a particular orientation. Thus, such graphite materials exhibit properties—such as thermal conductivity—that are highly directional. A highly ordered graphite material may have a thermal conductivity up to about 500 watts per meter Kelvin in the longitudinal plane, and as low as about 2.5 watts per meter Kelvin in the perpendicular plane. Thermally isotropic materials like metal have similar thermal conductivities in all directions. Aluminum, for example, has a thermal conductivity of about 250 watts per meter Kelvin an all planes of the material.

Various manufacturers make laminate graphite sheets. Some provide two outer polymeric protective layers and put powdered graphite between them. One manufacturer, GrafTech Inc. of Lakewood, Ohio, makes a laminate sheet, eGraf® SpreaderShield™, which comprises one or two outer structural layers. The outer structural layers may be made of various materials including plastic, natural fibers, acrylic, and the like. A flexible graphite sheet is disposed between two outer structural layers or is bonded to a single outer structural layer. Unlike other manufacturers, GrafTech does not use a powdered graphite but a compressed sheet of graphite, using a small amount of crystalline silica in the formulation as well. The graphite sheet is flexible and can be otherwise manipulated and shaped for the particular application. The eGraf® SpreaderShield™ may be purchased under product numbers 220, 290, 340, 365, 400, and 500. The product number represents the minimum thermal conductivity within the longitudinal plane of the eGraf® layer. In a preferred embodiment, the eGraf® SpreaderShield™ 340 or 400 may be used, to balance cost and thermal conductivity requirements. To minimize weight and expense, one embodiment of the present invention uses an eGraf® SpreaderShield™ 400 sheet as the heat spreading layer 102 with an overall thickness of about 17 mils. Depending on the desired radiant heating application, other eGraf® SpreaderShield™ products and thicknesses may be used, or other GrafTech Inc. products, such as Grafoil® may be used.

Embodiments of the present invention take advantage of graphite's anisotropic thermal conductive properties to provide and diffuse heat for use in the radiant heating system 100. In one example embodiment, use of a composite laminate sheet such as eGraf® SpreaderShield™ or similar product as the heat spreading layer 102 in conjunction with the other elements of the present invention, with a 120-volt electrical supply, about a 20-ampere current, and about 8.1 watts of power along each foot of the electrical heating element 104, the system 100 would provide 27.65 BTUs (British thermal units) of thermal energy per hour per foot of the heating element 104. eGraf® SpreaderShield's construction and anisotropic material orientation allows for radial heat dispersion of between about 10 to 12 inches along each side of the heating element 104 into the heat spreading layer 102. When an eGraf® SpreaderShield™ product is used with a higher thermal conductivity is used for the heat spreading layer 102, the heat spreading layer 102 will distribute and release the heat energy from the heating element 104 faster and more uniformly. Thus, a radiant heating system 100 according to this exemplary embodiment of the invention could provide for substantially continuous heat along a surface, planar or otherwise, with electrical heating element 104 spacing of about 20 to about 24 inches apart.

In one embodiment, the electrical heating element 104 comprises an electro-thermal coupling material or resistive element that is in contact with or bonded to the heat spreading layer 102. For example, the electrical heating element 104 may be a copper conductor. The copper conductor converts electrical energy to heat energy and transfers the heat energy to the surrounding environment. Alternatively, the electrical heating element 104 may comprise another conductor capable of converting electrical energy to heat energy. One skilled in the art of electro-thermal energy conversion will recognize additional materials suitable for forming the electrical heating element 104. Additionally, the electrical heating element 104 may include one or more layers for electrical insulation, temperature regulation, thermal transfer, ruggedization, or bonding. In one embodiment, the electrical heating element 104 may include two conductors connected at one end to create a closed circuit. In a further embodiment, the electrical heating element 104 may comprise a pliable multilayered electrical heating element or electrical heating tape as described in further detail with reference to FIG. 8B. In general, a pliable multilayered heating element as described with reference to FIG. 8B improves the thermal transfer from the electrical heating element 104 to the heat spreading layer 102.

In one embodiment, the thermal isolation layer 106 is disposed to one side of the heat spreading layer 102. The thermal isolation layer 106 ensures that heat generated by the electrical heating element 104 and distributed by the heat spreading layer 102 conducts away from the thermal isolation layer 106 and towards the finishing layer 108, and the area to be heated. The thermal isolation layer 106 may comprise an existing wooden or concrete layer that serve as a floor, subfloor, or wall. Alternatively, the thermal isolation layer comprises a thermally isolating or insulating material installed as a barrier for heat produced by the radiant heating apparatus 100. Foam insulation layers of as thin as a quarter inch, fiberglass or other insulation in a wall or ceiling may also serve as the thermal isolation layer 106. In various embodiments, the thermal isolation layer 106 may comprise existing structural layers such as sub-floors, sheeting, foundation walls, and the like. Alternatively, or in addition, the thermal isolation layer 106 may also include additional layers of insulation installed to provide a desired level of thermal isolation for the radiant heating apparatus 100.

In one embodiment, the finishing layer 108 is disposed to an opposite side of the heat spreading layer 102 as the thermal isolation layer 106. In general, the finishing layer 108 is the surface that the heat spreading layer 102 and the electrical heating element 104 are configured to heat. The finishing layer 108 in some embodiments, is the layer visible to an occupant of a room that includes the radiant heating system 100. The finishing layer 108 may be a flooring, wall, ceiling, or roofing material, such as tile, stone, hardwood or laminate flooring panels, certain carpets, certain linoleum, drywall, drop-ceiling panels, shingles, tar, asphalt or the like. Because of the efficiency of the electrical heating element 104 in combination with the heat spreading layer 102, the radiant heating system 100 may be configured to heat an entire room or space having the finishing layer 108.

In one embodiment, the electrical heating element 104 and the heat spreading layer 102 are planar, and an installer may install the finishing layer 108 directly over the electrical heating element 104 and the heat spreading layer 102. A planar electrical heating element 104 and heat spreading layer 102 facilitate installation of standard finishing layers 108 such that the installed finishing layer 108 conceals the radiant heating system 100. In another embodiment, a covering layer 107 may be installed over the electrical heating element 104 and the heat spreading layer 102 to provide a prepared surface for the finishing layer 108. The covering layer 107 may be concrete, mud, grout, glue or other bonding agents, an underlayment for tile or stone, or the like. The durability and reliability of the radiant heating system 100 allows for a permanent installation of the radiant heating system 100 beneath a permanent finishing layer 108.

In one embodiment, the electric power coupling 110 provides electrical power to the electrical heating element 104. In certain embodiments, the electric power coupling 110 may coupled to a power outlet connected to a standard residential or commercial power line, such as a 120V or 240V AC power line, depending on the geographical location. Alternatively, the electric power coupling 110 may be coupled to an electric generator. In certain embodiments, a 120V power line may supply a range of current between about 15A and about 50A of electrical current to the electrical heating element 104. Alternative embodiments may include a 240V AC power line. The 240V power line may supply a range of current between about 30A and about 70A of current to the electrical heating element 104. Various other embodiments may include supply of three phase power, Direct Current (DC) power, 110V or 220V power, or other power supply configurations based on available power, geographic location, and the like.

In a further embodiment, electrical couplings 110 connect multiple radiant heating sheets to heat to a larger area. Each radiant heating sheet comprises a heat spreading layer 102, an electrical heating element 104, and an electric power coupling as described. In one embodiment, the electric power coupling 110 may comprise an insulated wire conductor for transferring power to the next radiant heating sheet, solder, a crimp-on connector or terminal, an insulation displacement connector, a twist-on wire connector, a plug or socket connector, or the like. The electrical heating elements 104 may be connected in a series configuration, a parallel configuration, or a combination of the two.

In an alternative embodiment, the electrical heating element 104 may additionally provide the electrical coupling 110 without requiring a separate conductor. In certain embodiments, there may be a plurality of electric power couplings 110 positioned at different perimeter points about the radiant heating sheets for convenience in coupling multiple radiant heating sheets. For example, a second radiant heating sheet may be connected to a first radiant heating sheet by corresponding power couplings 110 to facilitate positioning of the radiant heating sheets end to end, side by side, in a staggered configuration, or the like.

Additionally, the electric power coupling 110 may include a Ground Fault Interrupter (GFI) or Ground Fault Circuit Interrupter (GFCI) safety device. The GFI device may be coupled to the power source. In certain embodiments, the GFI device may be connected to the electrical heating element 104 and interrupt the circuit created by the electrical heating element 104, as needed. The GFI device may protect the radiant heating system 100 from damage due to spikes in electric current delivered by the power source or other dangerous electrical conditions.

In one embodiment, the temperature control module 112 regulates the electrical power supplied to the electrical heating element 104 by the electric power coupling 110. In another embodiment, the temperature control module 112 is a thermostat. The temperature control module 112 may include a user interface and a temperature sensor to facilitate temperature regulation by a user. In a further embodiment, the temperature control module 112 may comprise a manual switch configured to regulate the electrical power. The manual switch may have on, off, or other adjustment settings. In one embodiment, the finishing layer 108 is a roofing layer, and the temperature control module 112 is a sensor configured to detect snow and ice accumulation on the roofing layer. The sensor may be a weight sensor, a precipitation and temperature sensor, or another type of sensor. The temperature control module 112 may regulate the electrical power supplied to a single radiant heating sheet, to multiple radiant heating sheets in a room or on a roof, or to multiple rooms of radiant heating sheets. The temperature control module 112 may be located in close proximity to the radiant heating sheets, remotely near the power supply, or in another suitable location.

In one embodiment, the width of the radiant heating sheets in the radiant heating system 100 are set to come within standard wall stud spacing widths 114 and ceiling joist spacing widths 116. Standard wall stud and ceiling joist spacing widths may include 12, 16, 19.2, or 24 inches on center, or other widths depending on geographic location, building application, and/or building codes. Sizing the width of the radiant heating sheets to come within standard wall stud and ceiling joist spacing widths prevents puncture of the radiant heating sheet by fasteners (screws, nails, etc) of the finishing layer 108. Preferably, the electrical heating element 104 is centered within the standard wall stud and ceiling joist spacing width to prevent shorting due to a metal fastener. In one embodiment, the radiant heating sheets may be installed in parts of a floor, wall, ceiling, roof, or other finishing layer 108 and not in others. For example, installing radiant heating sheets in a lower portion of a wall may be sufficient to heat some rooms. It may also be desirable to heat a perimeter of a roof, but not the center of the roof. In another embodiment, the heat spreading layer 102 may be resized, trimmed, or cut to facilitate installation. In a further embodiment, the electrical heating element 104 may be configured to be resized, trimmed or cut to facilitate installation.

It will be apparent to those skilled in the art that such a radiant heating sheet can also be used to provide heat in other applications, such as heating water pipes to prevent freezing, preventing ice or snow accumulation on outdoor surfaces such as concrete driveways, construction sites, sidewalks, and other applications. In one embodiment, the radiant heating sheet is flexible for use in various circumstances and situations.

Figure 2:
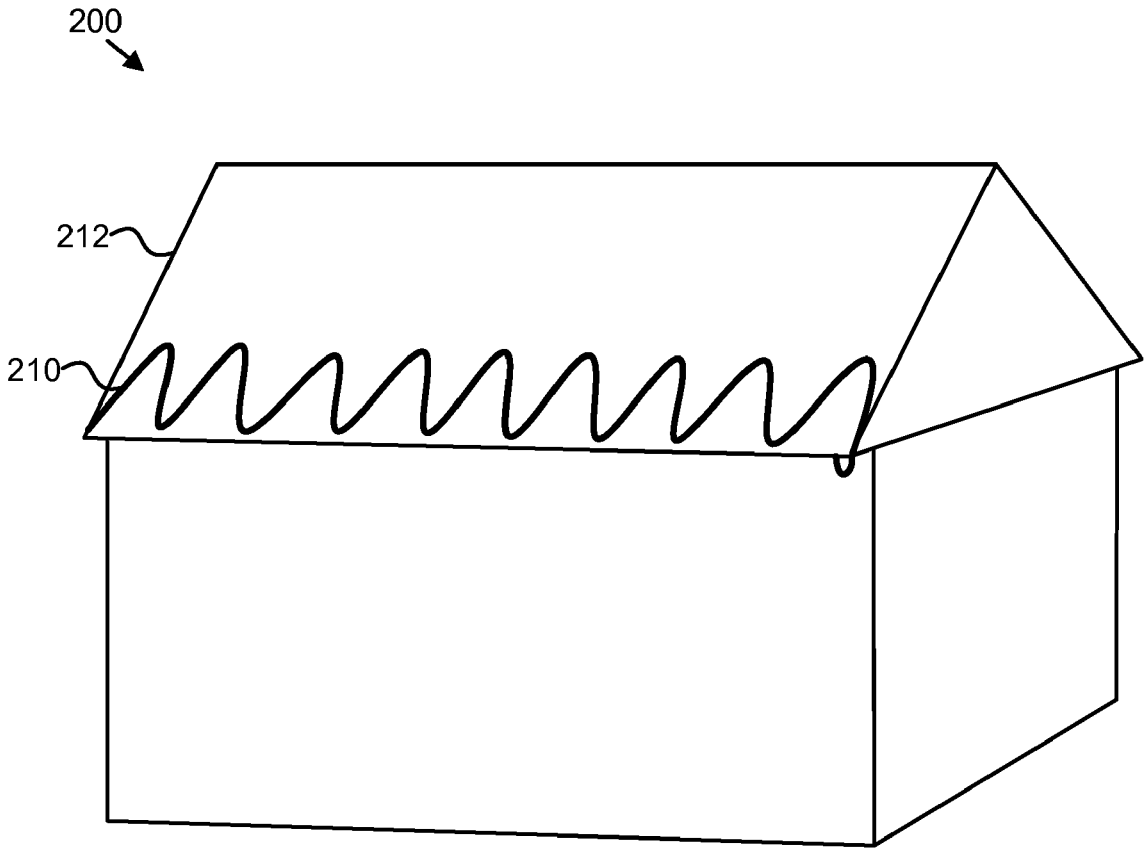
(Prior Art) FIG. 2
FIG. 2 is a perspective view of a prior art roof de-icing apparatus.
Figure 3:
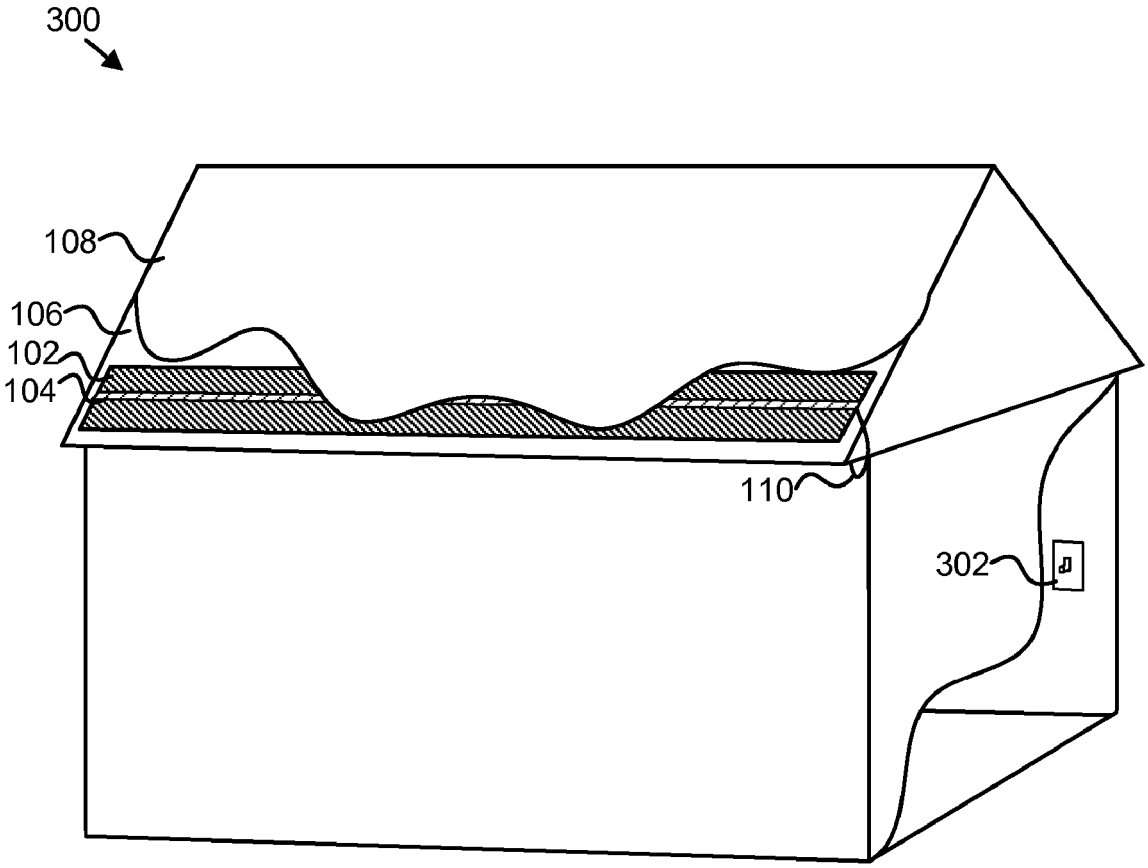
FIG. 3 is a perspective view of one embodiment of a roof de-icing apparatus according to one aspect of the invention.

One application of the invention is illustrated in FIG. 3. FIG. 2 shows an existing configuration of a roof de-icer 200, prevalent in geographical areas that receive large amounts of ice and snow. In existing configurations, a heating element 210, usually a wire or similar resistance heating device supplied with a small amount of electrical current, is placed in a zigzag formation on the lower portion of a roof 212 to melt snow and ice. The heat generated by the heating element 210 is not diffused, resulting in inefficient melting and often less-than-satisfactory removal of the snow and/or ice from the roof. Instead of complete removal, the process often results in a snow and ice melting pattern conforming exactly to the configuration of the heating element 210, with only a small amount of snow or ice melted and removed.

FIG. 3 illustrates a roof de-icer 300 according to one aspect of the present invention. In this embodiment, the heating element 104 is in contact with, or bonded to, the heat spreading layer 102. The heating element 104 provides heat to the system, with the heat spreading layer 102 distributing the heat as described above. The heating element 104 receives power through the electric power coupling 110. Thus, the heat generated by the heating element 104 is not restricted to a small area around the heating element 104. The heat is distributed as detailed above, resulting in the removal of a larger volume of snow from the roof. The roof de-icer 300 also includes a thermal isolation layer 106, which may be a sub-roofing layer, and a finishing layer 108, which may be a roofing layer. In one embodiment, the heat spreading layer 102 with its heating element 104 is sized and shaped to substantially match the size and shape of the finishing layer 108 which is the roofing layer. In other words, the roof de-icer 300 may be substantially the same size as the roofing layer it is heating. The electrical power that the electric power coupling 110 supplies to the heating element 104 may be regulated by a temperature control module 302, which may be a switch, thermostat, or sensor as described above.

Figure 4:
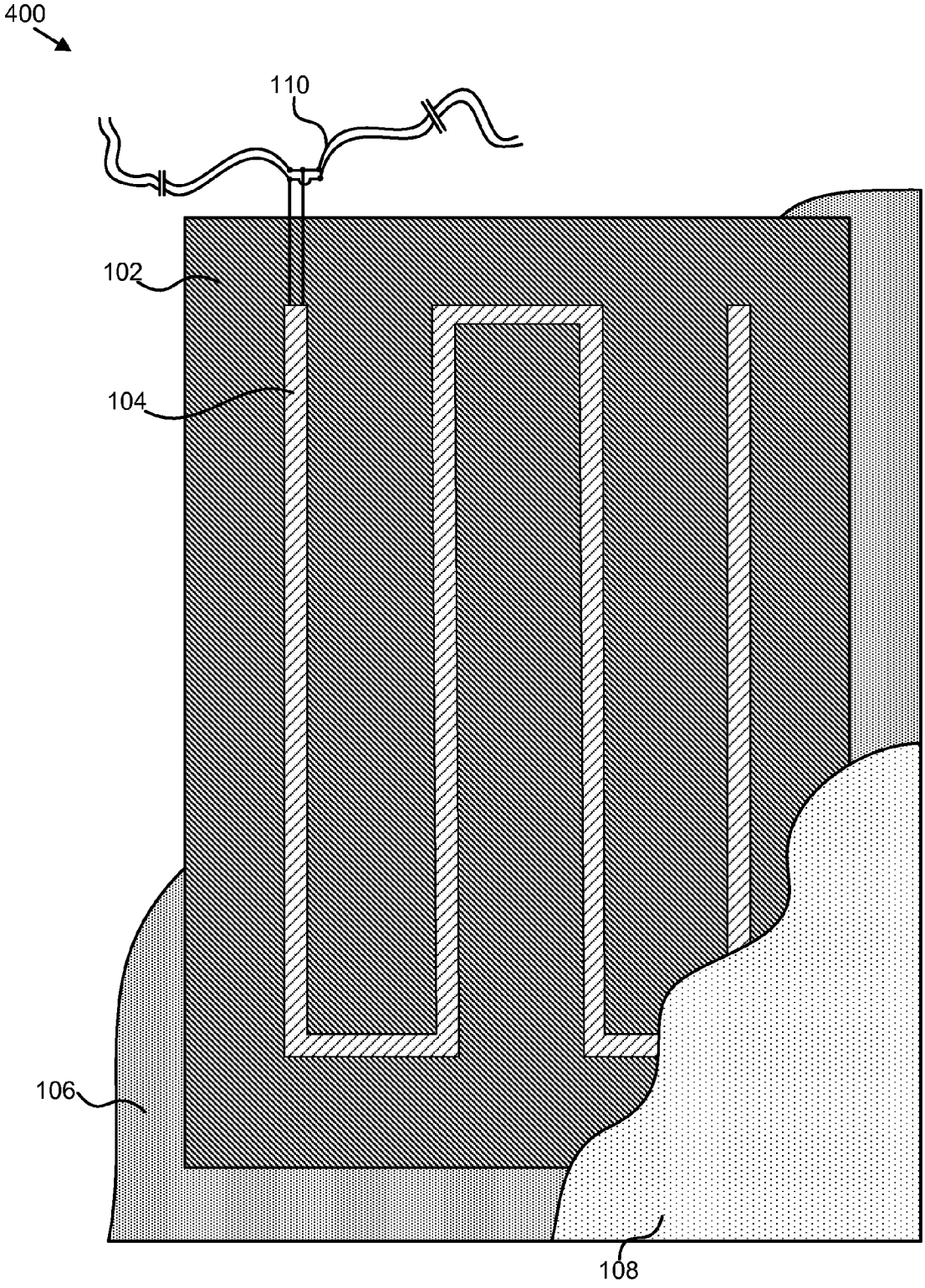
FIG. 4 is a schematic diagram illustrating one embodiment of a radiant heating apparatus according to one aspect of the invention.

FIG. 4 illustrates a radiant heating apparatus 400 according to one aspect of the present invention. In one embodiment, the radiant heating apparatus 400 is a core radiant heating sheet. A core radiant heating sheet is a radiant heating sheet, as defined above, which is selected from a set of radiant heating sheets with predefined sizes that are connectable to a power supply with the electric power coupling 110. In another embodiment, the radiant heating apparatus 400 is a filler radiant heating sheet. A filler radiant heating sheet is a radiant heating sheet, as defined above, which is selected from a set of radiant heating sheets with predefined sizes that are connectable to another radiant heating sheet (core or filler) with the electric power coupling 110. Preferably, a core radiant heating sheet is available in a set of larger sizes than filler heating sheets.

In certain embodiments, the core and filler radiant heating sheets are available to builders and do-it-your-selfers in a predetermined set of standard sizes in feet may include 2×2, 2×4, 5×5, 5×10, 5×15, 5×20, 5×25, 5×50, 10×10, 10×15, 10×20, and 10×25. Larger radiant heating sheet sizes will typically be core radiant heating sheets, and smaller radiant heating sheet sizes will be filler radiant heating sheets. Different shapes may be used for the radiant heating sheets. Standard rooms may call for generally square and/or rectangular radiant heating sheets, while rooms with bay windows or other irregularities may call for semicircular or triangular radiant heating sheets. The manufacturer and the manufacturing process of the heat spreading layer 102 may also dictate the sizes of the radiant heating sheets. In certain embodiments, an installer may cut the heat spreading layer 102 to a suitable size for a particular installation taking care not to cut the heating element 104. In this manner, the radiant heating apparatus 100 can be installed beneath a flooring to provide heat from wall to wall in a room.

In one embodiment, the core radiant heating sheet, consisting of the heat spreading layer 102, the electrical heating element 104, and the electric power coupling 110, is placed to one side of the thermal isolation layer 106. For a floor installation, the core radiant heating sheet is placed above the thermal isolation layer 106. For a ceiling or wall installation, the core radiant heating sheet is placed below or in front of the thermal isolation layer 106. Preferably, the thermal isolation layer 106 is sized to substantially cover a floor, wall, or ceiling. The size of the core heating sheet is then selected to maximize the surface area coverage of the floor, wall, or ceiling. The core heating sheet may be installed in one corner of the room. The electric power coupling 110 of the core radiant heating sheet may be coupled to electrical power.

Next, one or more filler radiant heating sheets are selected to cover surfaces of the floor, wall, or ceiling uncovered by the core radiant heating sheet. The one or more filler gradiant heating sheets are laid next to the core radiant heating sheet or each other and coupled by corresponding electric power couplings 110. In this manner, the combined surface area of the radiant heating sheets substantially covers the thermal isolation layer 106 and heats the whole finishing layer 108. Although many patterns may be used, in the radiant heating apparatus 400 the electrical heating element 104 is laid out in a generally serpentine pattern on the heat spreading layer 102.

Figure 5:
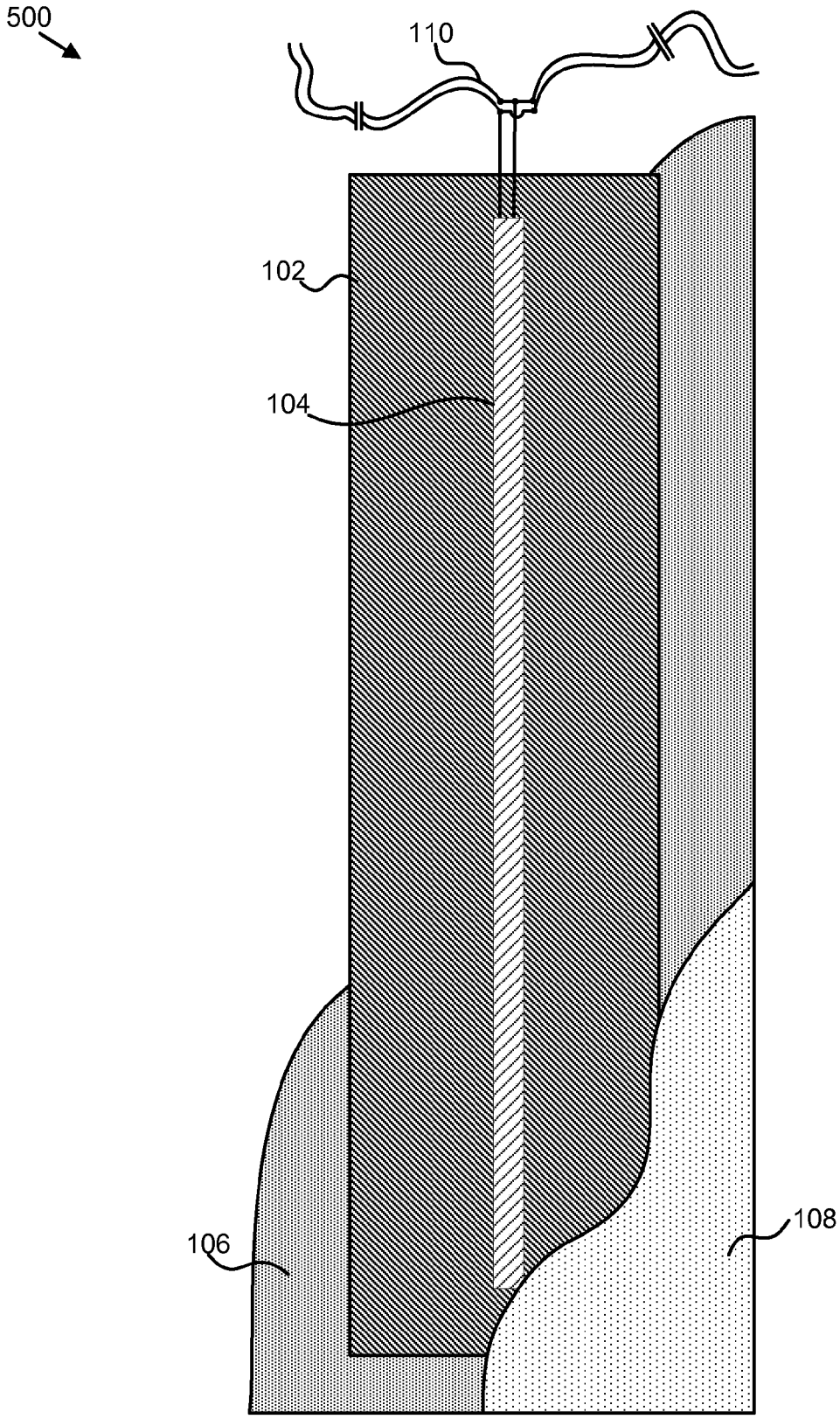
FIG. 5 is a schematic diagram illustrating a further embodiment of a radiant heating apparatus according to one aspect of the invention.

FIG. 5 illustrates a radiant heating apparatus 500 according to one aspect of the present invention. In one embodiment, the radiant heating apparatus 500 is substantially similar to the radiant heating apparatus 400 of FIG. 4. In another embodiment, the radiant heating apparatus 500 is a filler radiant heating sheet that may be used in conjunction with the core radiant heating sheet 400 of FIG. 4. The electrical heating element 104 of the radiant heating apparatus 500 is laid out in a generally linear pattern along the center of the heat spreading layer 102. In a further embodiment, the dimensions of the radiant heating apparatus 500 are configured for use in a wall or ceiling between wall studs or ceiling joists.

Figure 6:
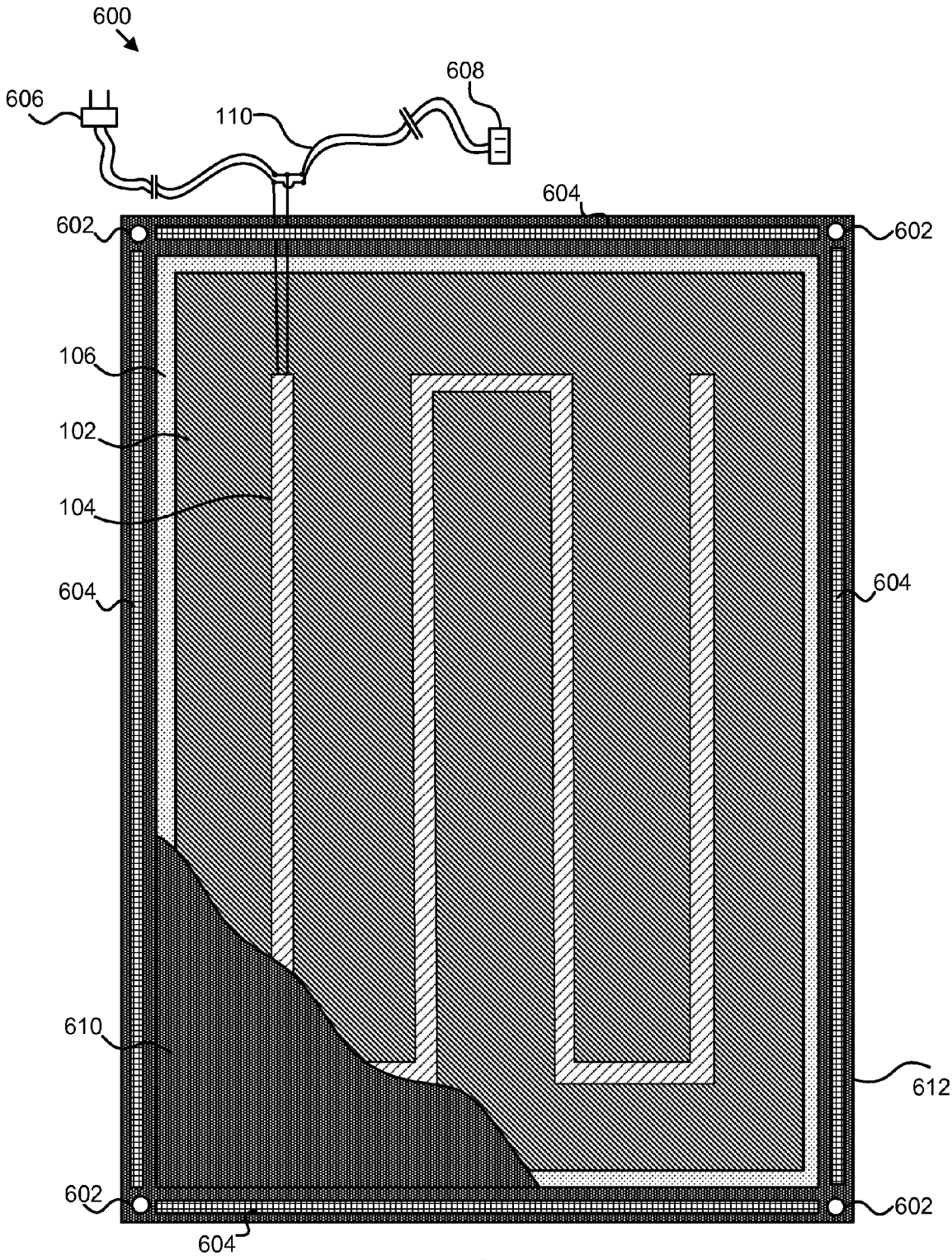
FIG. 6 is a schematic diagram illustrating one embodiment of a portable radiant heating apparatus according to one aspect of the invention.

FIG. 6 illustrates one embodiment of a portable pliable radiant heating apparatus 600 according to one aspect of the invention. The portable pliable radiant heating apparatus 600 may be used in a variety of ways. The portable pliable radiant heating apparatus 600 may be used in a similar manner to a standard blanket, except that the portable pliable radiant heating apparatus 600 radiates heat up away from the ground or other support structure. Additionally, like a blanket, the portable pliable radiant heating apparatus 600 protects those sitting or standing on it from water and dirt beneath.

The portable pliable radiant heating apparatus 600 in certain embodiments may be used to heat tents, canopies, barns, sheds, livestock, sporting and other outdoor events, and other remote or mobile shelters or objects. In one embodiment, the radiant heating apparatus 600 includes a radiant heating sheet comprising a heat spreading layer 102, an electrical heating element 104, and an electric power coupling 110 that is substantially similar to the radiant heating sheet 400 of FIG. 4. The portable pliable radiant heating apparatus 600 may also include a thermal isolation layer 106, a top pliable outer layer 610, a bottom pliable outer layer 612, fasteners 602, 604, a male power plug 606, and a female power plug 608.

In one embodiment, the portable pliable radiant heating apparatus 600 is configured for use as a foot warmer underneath a table or desk. In such an embodiment, the portable pliable radiant heating apparatus 600 may be about 2 feet wide by 2 feet long. The portable pliable radiant heating apparatus 600 may include the male power plug 606, described below, and one or more female power plugs 608, also as described below. The one or more female power plugs 608 may be used to join multiple portable pliable radiant heating apparatuses 600 or to connect other electrical devices such as computers, monitors and the like.

In certain embodiments the foot warmer portable pliable radiant heating apparatus 600 may be used as a seat warmer and may operate on battery power. The smaller dimensions results in shorter lengths of electrical heating element 104 such that one or more standard batteries may be used.

In one embodiment, the layers of the portable pliable radiant heating apparatus 600 comprise fire retardant material. In one embodiment, the materials used in the various layers of the portable pliable radiant heating apparatus 600 are selected for high durability in an outdoor environment, light weight, fire retardant, sun and water rot resistant characteristics, water resistant characteristics, pliability, and the like. For example, the portable pliable radiant heating apparatus 600 may comprise material suitable for one man to roll, carry, and spread the portable pliable radiant heating apparatus 600 in a wet, rugged, and cold environment. Therefore, the material is preferably lightweight, durable, water resistant, fire retardant, and the like. Additionally, the material may be selected based on cost effectiveness. In one embodiment, the top pliable outer layer 610 may be positioned on the top of the radiant heating sheet. A bottom pliable outer layer 612 is on the bottom of the radiant heating sheet. In certain embodiments, the top outer layer 610 and the bottom outer layer 612 may comprise the same or similar material. Alternatively, the top outer layer 610 and the bottom outer layer 612 may comprise different materials, each material possessing properties beneficial to the specified surface environment.

For example, the top outer layer 610 may comprise a material that is resistant to damage due to shoes and boots such as polyester, plastic, and the like. The bottom outer layer 612 may comprise material that is resistant to mildew, mold, and water rot such as nylon. The outer layers 610, 612 may comprise a highly durable material. The material may be textile or sheet, and natural or synthetic. For example, the outer layers 610, 612 may comprise a nylon textile. Additionally, the outer layers 610, 612 may be coated with a water resistant or waterproofing coating. For example, a polyurethane coating may be applied to the outer surfaces of the outer layers 610, 612.

In one embodiment, the thermal isolation layer 106 provides thermal insulation to conduct heat generated by the resistive element 104 away from the thermal isolation layer 106. In one embodiment, the thermal isolation layer 106 is a sheet of polystyrene. Alternatively, the thermal isolation layer 106 may include cotton batting, Gore-Tex®, fiberglass, or other insulation material. In certain embodiments, the thermal isolation layer 106 may be integrated with either the first outer layer or the second outer layers 108. For example, the bottom outer layer may comprise an insulation fill or batting disposed between two films of nylon.

In one embodiment, the heat spreading element 102 is placed in direct contact with the resistive element 104. The heat spreading element 102 may conduct heat away from the resistive element 104 and spread the heat for a more even distribution of heat. The heat spreading element 102 may comprise any heat conductive material, or may comprise a thermally anisotropic material as described above.

In one embodiment, the portable pliable radiant heating apparatus 600 includes one or more fasteners 602, 604 to facilitate the fastening of the portable pliable radiant heating apparatus 600 to one or more walls of a mobile shelter. In one embodiment, the portable pliable radiant heating apparatus 600 is sized for cover the surface area of a floor of a mobile shelter. The portable pliable radiant heating apparatus 600 may serve as a floor for the mobile shelter, or may be placed below or above the floor of a mobile shelter. In one embodiment, the fasteners 602, 604 are attached to the outer layers 108 or to a flap around the outer layers 108. The fasteners 602, 604 may be rivets, Velcro®, laces, ties, hooks, weather stripping, adhesive fabric or tape, or another type of fastener. Furthermore, the perimeter and/or a flap of the outer layers 108 may include a corresponding fastener 602.604 on the its backside that facilitates joining one or more portable pliable radiant heating apparatus 600 together.

As described above, in one embodiment, the electric power coupling 110 may couple the radiant heating apparatus 600 to electrical power and to other radiant heating apparatuses. The electrical power may be provided by a standard residential or commercial electrical outlet, a generator, a battery, a fuel cell, or another electrical power source. In another embodiment, the electrical power coupling 110 further comprises a male power plug 606 and a female power plug 608. The male power plug 606 may be plugged into an electrical power socket, or into the female power plug 608 of another radiant heating apparatus. As described above, the electrical power coupling 110 may connect the radiant heating apparatuses in series or parallel.

Figure 7:
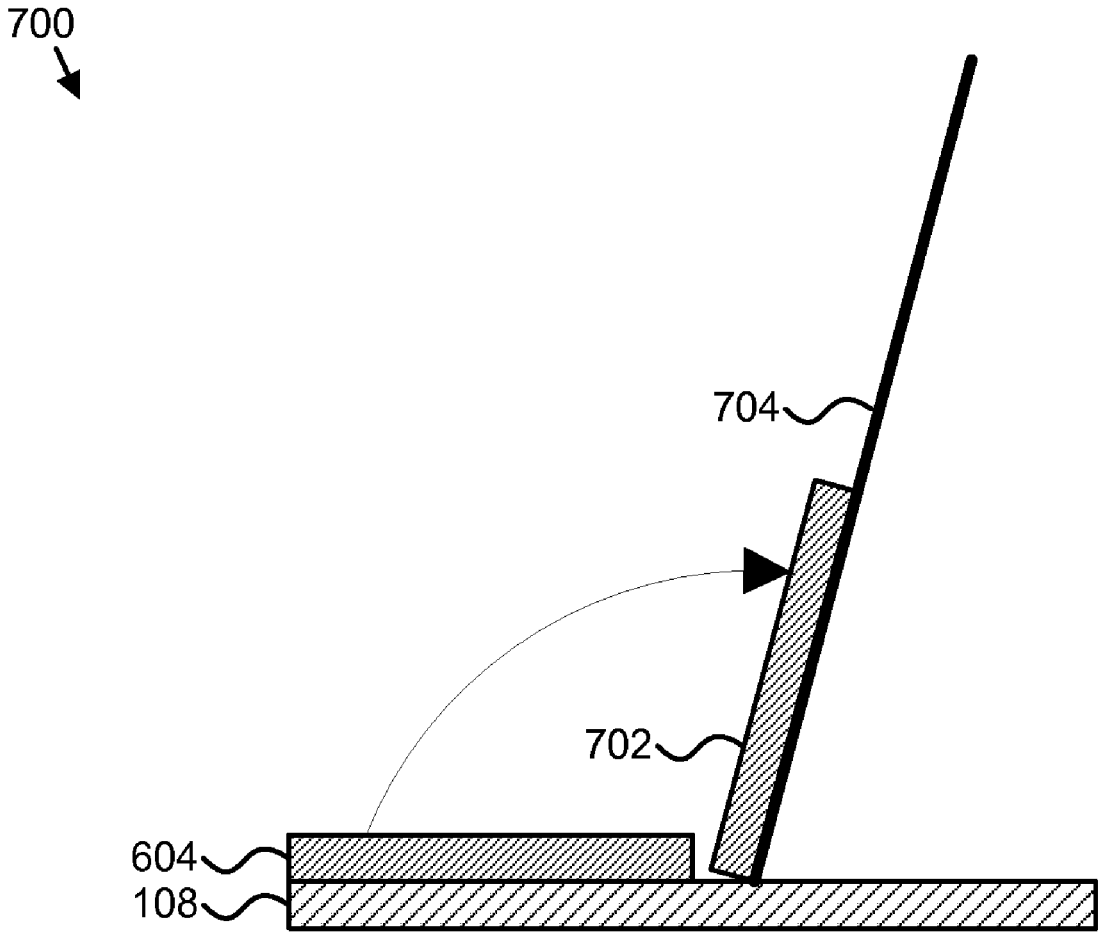
FIG. 7 is a schematic diagram illustrating one embodiment of a fastener according to one aspect of the invention.

FIG. 7 illustrates a cross-sectional diagram of one embodiment of a fastener 700. In one embodiment, the fastener 700 includes a flap 702, a flooring fastener 604, a corresponding shelter fastener 704, and a shelter wall 706. In one embodiment, the flap 702 may be a portion of one or both of the outer layers 610, 612 of FIG. 6, or a separate flap extending six inches from the edges of the portable pliable radiant heating apparatus 600 of FIG. 6. In one embodiment, the flap 702 may additionally include heavy duty riveted edges (not shown). The flap 702 may comprise a joined portion of the top and bottom outer layers 610, 612 that extends around the perimeter of the portable pliable radiant heating apparatus 600 of FIG. 6 and may not include any intervening layers such as a heat spreading layer 102 or a thermal isolation layer 106.

In one embodiment, the flooring fastener 604 and the shelter fastener 704 may substantially provide air and water isolation. In one embodiment, the flooring and shelter connecting means 604, 704 may include weather stripping, adhesive fabric, Velcro®, or the like.

Figure 8A:
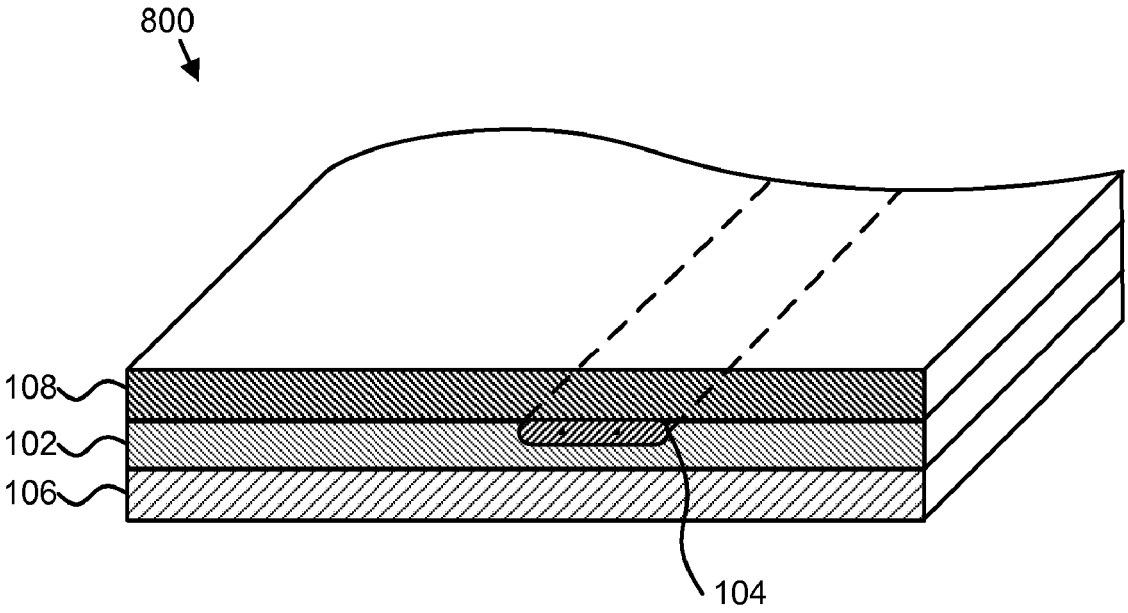
FIG. 8A is a schematic cross-sectional diagram illustrating one embodiment of a radiant heating apparatus according to one aspect of the invention.

FIG. 8A illustrates one embodiment of a radiant heating apparatus 800. In one embodiment, the radiant heating apparatus 800 includes a finishing layer 108, a multilayered electrical heating element 104, a heat spreading element 102, and a thermal isolation layer 106.

In certain embodiments, the thermal isolation layer 106 provides thermal isolation to retain heat generated by the multilayered electrical heating element 104 to the opposite side of the thermal isolation layer 106. Typically, the thermal isolation layer 106 is positioned to the side of the heat spreading layer 102 and the multilayered electrical heating element 104 such that heat is directed towards the finishing layer 108. Typically, there is no thermal isolation layer 106 between the multilayered electrical heating element 104 and the finishing layer 108. In this manner, the heat is conducted and/or radiated unimpeded towards the finishing layer 108.

The thermal isolation layer 106 permits the heat spreading element 102 to conduct away heat trapped by the thermal isolation layer 106. The thermal isolation layer 106 provides minimal thermal conductivity (i.e. High R-value). The multilayered electrical heating element 104 may alternatively be positioned between the thermal isolation layer 106 and the heat spreading layer 102.

In one embodiment, the thermal isolation layer 106 is substantially similar to the thermal isolation layer 106 described above in relation to FIG. 1. In another embodiment, the thermal isolation layer 106 comprises an aerogel in laminate form. For example, suitable aerogels that may be used for the thermal isolation layer 106 are known by the trademarks of Spaceloft™ AR5101, Spaceloft™ AR5103 available from Aspen Aerogels, Inc. of Northborough, Mass. USA.

Other aerogel materials that may be suitable for the thermal isolation layer 106 may include Spaceloft™ AR3101, Spaceloft™ AR3102, Spaceloft™ AR3103, Pyrogel® AR5222, Pyrogel® AR5223, Pyrogel® AR5401, Pyrogel® AR5402 or the like. Alternatively, the thermal isolation layer may include cotton batting, Gore-Tex®, fiberglass, wood or other insulation material.

As described above, in one embodiment, the heat spreading element 102 is placed in direct contact with or bonded to the multilayered electrical heating element 104. The heat spreading element 102 may conduct heat away from the multilayered electrical heating element 104, drawing out the heat and spreading the heat for a more even distribution of heat. The heat spreading element 102 may comprise any heat conductive material substantially similar to the heat spreading element 102 described above in relation to FIG. 1.

Figure 8B:
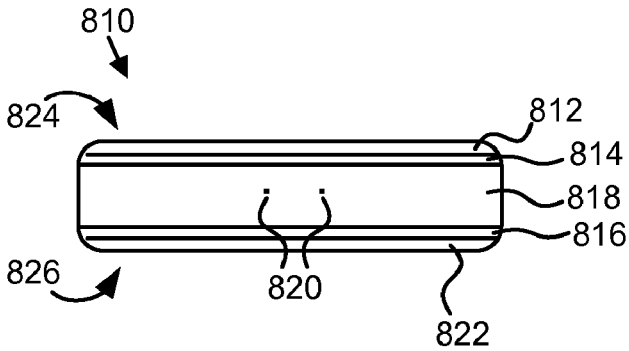
FIG. 8B is a schematic cross-section diagram illustrating one embodiment of a pliable multilayered electrical heating element according to one aspect of the invention.

FIG. 8B illustrates a cross-section view of the multilayered electrical heating element 810 that may be substantially similar to the electrical heating element 104 described in relation to the previous figures. Typically, the multilayered electrical heating element 810 is between about 0.02 inches and 0.03 inches thick and between about ⅙ of an inch and ½ of an inch wide. Advantageously, the small dimensions of the multilayered electrical heating element 810 reduce the overall weight of the radiant heating apparatus 800. In certain embodiments, the multilayered electrical heating element 810 is referred herein to as electrical heating tape 810. The configuration of the electrical heating tape 810 is specifically designed to suit the heating requirements for different embodiments of the radiant heating apparatus 800.

The multilayered electrical heating element 810 includes a thermal reflection layer 812, a first separation layer 814, a second separation layer 816, with an adhesive 818 and at least two resistive elements 820 disposed between the first separation layer 814 and second separation layer 816. Optionally, in certain embodiments, the multilayered electrical heating element 810 also includes a backing 822. The multilayered electrical heating element 810 includes a top 824 and a bottom 826.

The thermal reflection layer 812 reflects heat radiated from the resistive elements 820 back towards the resistive elements 820. The thermal reflection layer 812 is preferably at the top 824 of the multilayered electrical heating element 810 such that the heat generated by the multilayered electrical heating element 810 is directed towards the bottom 826. The thermal reflection layer 812 is preferably made from a highly reflective material such as aluminum, gold, or other pure metal or metal alloy foil. Alternatively, the thermal reflection layer 812 may comprise a fibrous man-made or natural material that includes a reflective coating on the side facing the bottom 826. Typically, the thermal reflection layer 812 is very thin.

The first separation layer 814 and second separation layer 816 separate the resistive elements 820 from directly contacting the reflection layer 812 or a surface contacting the electrical heating tape 810. The first separation layer 814 and second separation layer 816 may be formed from the same materials and have substantially the same configuration, or may be formed of different materials. The separation layers 814, 816 electrically insulate the resistive elements 820 from contacting electrically conductive material (such as the thermal reflection layer 812 or a conductive surface) that may cause an electrical short. The separation layers 814, 816 also maintain the positioning of the resistive elements 820 relative to each other and within the electrical heating tape 810.

Typically, the resistive elements 820 comprise a conductive wire such as copper, silver, gold, or the like. In certain embodiments, the resistive elements 820 are specifically configured to handle expansion during use and contraction when not in use. For example, the resistive elements 820 may include a squiggle (a slight bend up and down along the length of the resistive element). The squiggle permits the resistive element 820 to expand and extend its length when energized and contract and return to an original shape when the resistive element 820 is not energized. In certain embodiments, the resistive elements 820 may include an enamel coating that serves as one example of an insulator which further insulates against an electrical short.

In certain embodiments, in addition to electrical insulation, the first separation layer 814 and second separation layer 816 facilitate conduction of thermal energy from the resistive elements 820 to the heat spreading element 102. Accordingly, in one embodiment, the first separation layer 814 and second separation layer 816 comprise a porous material that permits the adhesive 818 to impregnate the first separation layer 814 and second separation layer 816. In this manner, the adhesive 818 serves as a thermal conductor carrying heat from the resistive elements 820 through the first separation layer 814 and second separation layer 816. In particular, the adhesive 818 conducts heat from the resistive elements 820 to the heat spreading element 102.

Thermal energy can be transmitted by conduction through a material, by conduction through a gas, and by radiation. The thermal reflection layer 812 reflects radiated heat. Gas conduction through a gas such as air is typically not effective because gas has a low thermal conductivity. The adhesive 818 serves as a material conductor of heat energy in place of the gas or air that ordinarily might surround the resistive elements 820.

In one embodiment, the first separation layer 814 and second separation layer 816 may comprise a woven material such as woven fiberglass strands. Of course other man-made and natural electrically insulating materials may be woven to form the first separation layer 814 and second separation layer 816. The holes in the weave permit the adhesive 818 to penetrate the layers 814, 816.

The adhesive 818 serves to hold layers 812, 814, 816, and 822 together. In addition, the adhesive facilitates conduction of thermal energy from the resistive elements 820 to the heat spreading element 102. The adhesive 818 has an effective operating temperature range of between about −100 degrees Celsius and about 250 degrees Celsius and a high thermal conductivity. The adhesive 818 in certain embodiments is a silicon adhesive readily available to those of skill in the art. Alternatively, the adhesive 818 is an acrylic adhesive that is also readily available. The thickness of the adhesive 818 may range between about 0.025 to about 0.028 inches.

In certain embodiments, the adhesive 818 serves to adhere the multilayered electrical heating element 810 to the heat spreading element 102. In certain embodiments, a secondary bonding agent such as various tapes including masking tape, duct tape, electrical tape or glues may be used to enhance the adhesion of the multilayered electrical heating element 810 to the heat spreading element 102. In one embodiment, the backing 822 is readily removable such that the second separation layer 816 can be directly connected to the heat spreading element 102 by way of the adhesive 818. In this manner, the adhesive 818 provides a direct thermal path for heat from the resistive elements 820 to the heat spreading element 102.

Advantageously, the type and configuration of the multilayered electrical heating element 810 depending on the heating requirements for the radiant heating apparatus or system 100, 300, 400, 500, 600, 800. For example, the number of resistive elements 820 can vary between two and multiples of two up to about 12 resistive elements 820. Of course, as the number of resistive elements 820 increases the width of the multilayered electrical heating element 810 may be increased to maintain adequate inter-resistive element spacing. As the number of resistive elements 820 changes and the length of the multilayered electrical heating element 810 changes, other characteristics of the multilayered electrical heating element 810 may also be changed. Advantageously, this flexibility permits the multilayered electrical heating element 810 to be used in various different radiant heating apparatus 800 configurations, including those discussed above.

Typically, the multilayered electrical heating element 810 generates about nine watts of power per foot. Depending on the length of the multilayered electrical heating element 810 and the number of resistive elements 820, the multilayered electrical heating element 810 draws between about 5.4 amperes and about 20 amperes with a resistance of between about 24 ohms and about 5.9 ohms. In addition, the multilayered electrical heating element 810 uses between about 0.65 kilowatts per hour and about 4.8 kilowatts per hour. Beneficially, these ranges are within those available on a 120 Volt circuit or a 240 Volt circuit protected by a 20 Amp breaker as found at most residential sites. When using a 120 Volt circuit with a 20 Amp breaker, about up to 269 feet of the multilayered electrical heating tape 810 may be used in the radiant heating apparatuses coupled to the circuit. Of course, other sizes of breakers may be used with the present invention as well.

Figure 9A:
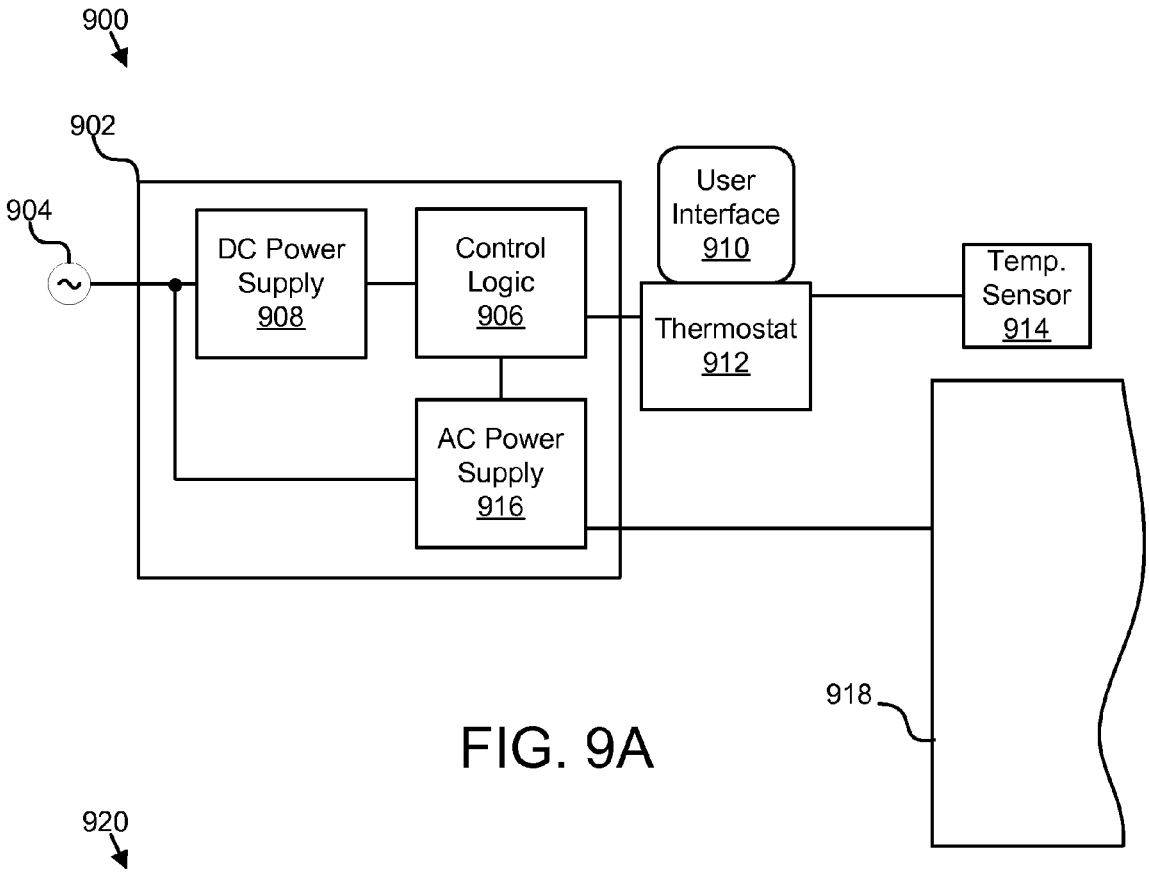
FIG. 9A is a schematic block diagram illustrating one embodiment of a temperature control module according to one aspect of the invention.

FIG. 9A illustrates one embodiment of a modular temperature control unit 900. In one embodiment, the temperature control unit may include a housing 902, control logic 906, a DC power supply 908 connected to an AC power source 904, an AC power supply for a radiant heating apparatus 918, a user interface 910 with an adjustable user control 912, and a temperature sensor 914.

In one embodiment, the control logic 906 may include a network of amplifiers, transistors, resistors, capacitors, inductors, or the like configured to automatically adjust the power output of the AC power supply 916, thereby controlling the heat energy output of the resistive element 104. In another embodiment, the control logic 906 may include an integrated circuit (IC) chip package specifically for feedback control of temperature. In various embodiments, the control logic 906 may require a 3V-25V DC power supply 908 for operation of the control logic components.

In one embodiment, the user interface 910 comprises an adjustable potentiometer. Additionally, the user interface 910 may comprise an adjustable user control 912 to allow a user to manually adjust the desired power output. In certain embodiments, the user control may include a dial or knob. Additionally, the user control 912 may be labeled to provide the user with power level or temperature level information.

In one embodiment, the temperature sensor 914 is integrated in the radiant heating apparatus 918 to provide variable feedback signals determined by the temperature of the radiant heating apparatus 918. In another embodiment, the temperature sensor 914 is integrated in an area heated by the radiant heating apparatus 918 to provide variable feedback signals determined by the temperature of the area heated by the radiant heating apparatus 918. For example, in one embodiment, the control logic 906 may include calibration logic to calibrate the signal level from the temperature sensor 914 with a usable feedback voltage.

Figure 9B:
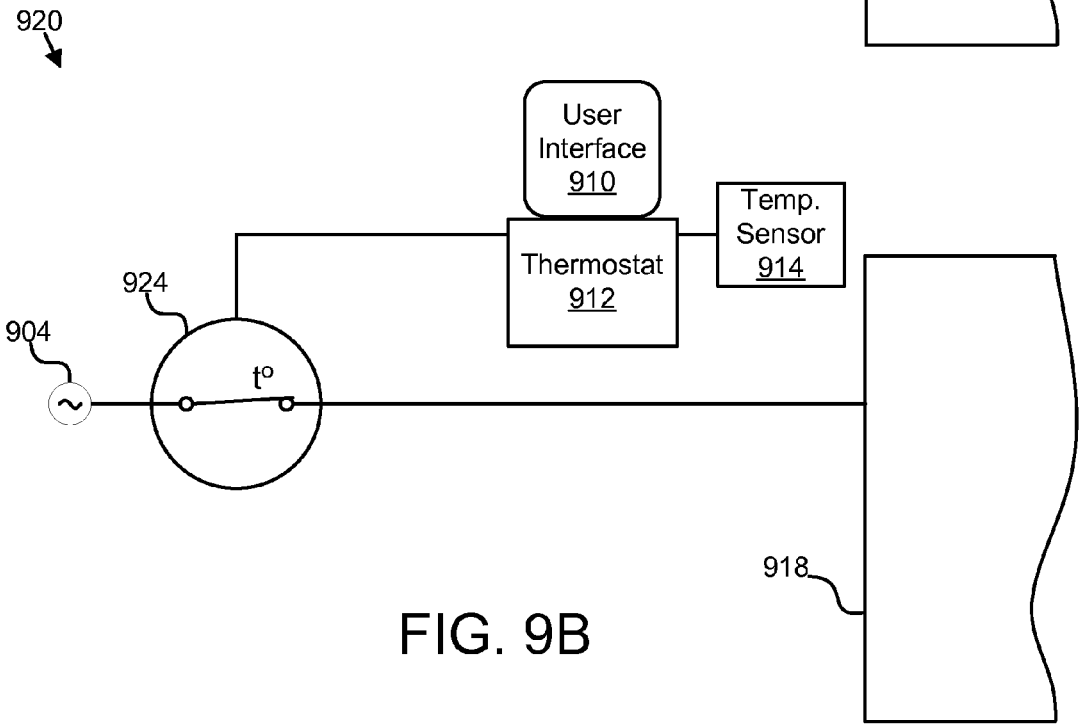
FIG. 9B is a schematic block diagram illustrating another embodiment of a temperature control module according to one aspect of the invention.

FIG. 9B illustrates an embodiment of a modular temperature control unit 920. In one embodiment, the AC power source 904, the user interface 910 with the adjustable user control 912, the temperature sensor 914, and the radiant heating apparatus 918 are substantially similar to the elements described above with regard to FIG. 9A.

In one embodiment, the modular temperature control unit 920 also includes a thermostat controlled switch 924 coupled electrically between the AC power source 904 and the radiant heating apparatus 918. The thermostat controlled switch 924 may be configured to open the switch and thereby to prevent the supply of power from the AC power source 904 from reaching the radiant heating apparatus 918 in response to a temperature reading from the temperature sensor 914 that is higher than a threshold temperature defined by the adjustable user control 912. The thermostat controlled switch 924 may also close the switch and thereby provide the radiant heating apparatus 918 with power from the AC power source 904 in response to a temperature reading from the temperature sensor 914 that is lower than a threshold temperature defined by the adjustable user control 912.

The flow chart diagram that follows is generally set forth as a logical flow chart diagram. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 10:
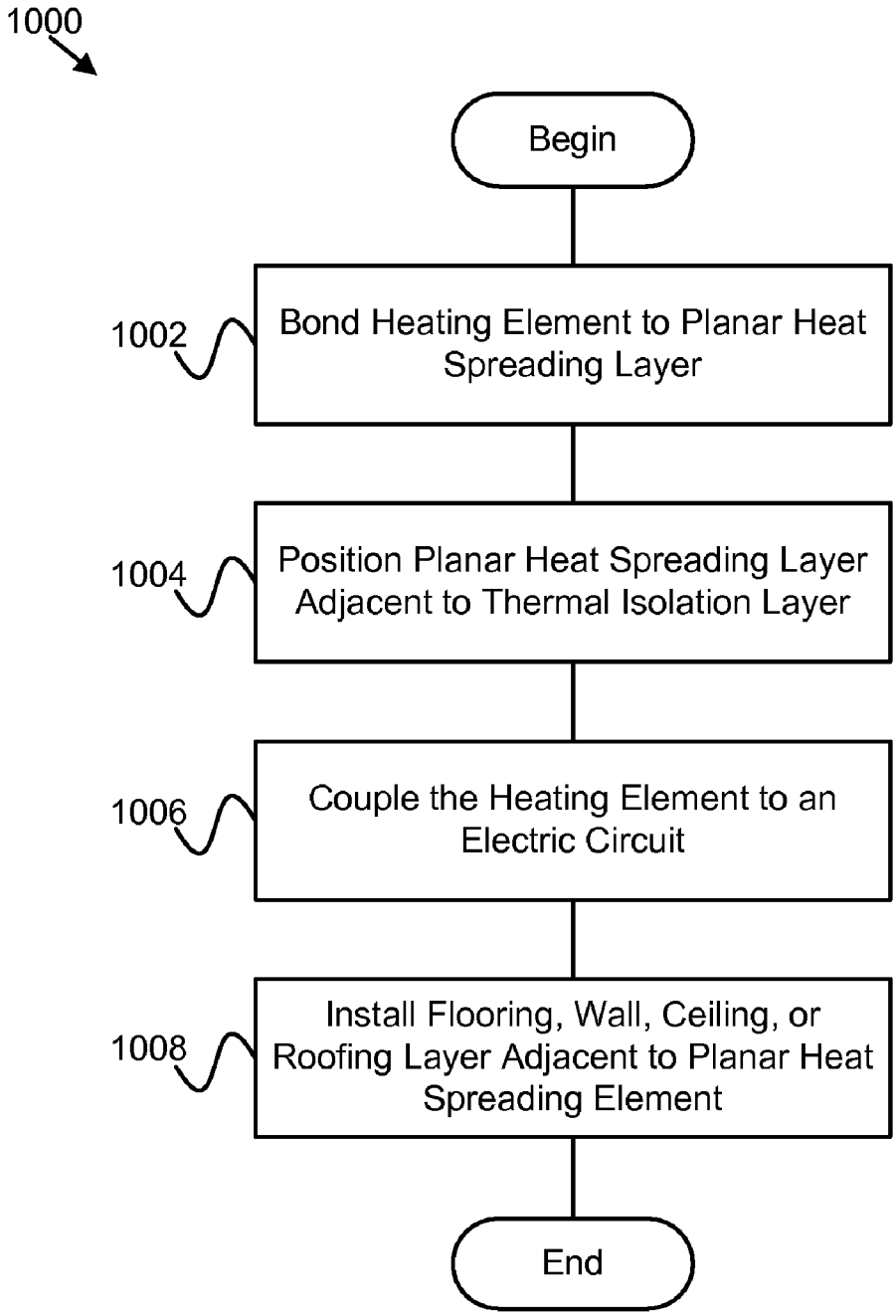
FIG. 10 is a flow chart diagram illustrating a method for installing a radiant heating apparatus according to one embodiment of the present invention.

FIG. 10 is a flow chart diagram illustrating a method 1000 for installing a radiant heating apparatus according to one embodiment of the present invention. The installer may bond 1002 a heating element 104 to a planar heat spreading layer 102. The heating element 104 and the heat spreading layer 102 may be substantially similar to the heating element 104 and the heat spreading layer 102 described above.

The installer positions 1004 the planar heat spreading layer 102 and the bonded heating element 104 adjacent to the thermal isolation layer 106 (above the thermal isolation layer 106 for a flooring installation and in front of the thermal isolation layer 106 for a wall or ceiling installation). This step may also include installing the thermal isolation layer 106 if it has not yet been installed. As described above, the thermal isolation layer 106 may be an existing sub-floor, wall or ceiling insulation, or a sub-roofing layer.

The installer couples 1006 the heating element 104 to an electric circuit. In one embodiment, a single electric circuit services a whole room that includes the radiant heating system 100. The electric circuit may comprise a power supply, a breaker, a temperature control module 112 and one or more additional radiant heating apparatuses. As described above, the coupling 1006 may comprise soldering wires, crimping or heating a wire connector, twisting a twist-on wire connector, coupling plugs, or the like.

The installer installs 1008 the finishing layer 108 on a side of the planar heat spreading element 102 opposite the thermal isolation layer 106. The finishing layer 108 may be a flooring, wall, ceiling, or roofing layer as described above. This step may also include installing a covering layer 107 to provide a prepared surface for the finishing layer 108. The covering layer 107 may provide a more level surface or a bonding surface for the finishing layer 108.

The present invention may be embodied in other specific forms without departing from its spirit or essential characteristics. For example, the graphite or other suitably anisotropic material used to diffuse the heat of the heating element need not necessarily be planar to remain within the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A radiant heating apparatus, comprising:

a planar electrical heating element configured to convert electrical energy to heat energy;

a planar carbon-based heat spreading layer comprising a laminate graphite sheet that is positioned in direct physical contact with the planar electrical heating element and which is also configured to draw the heat energy out of the planar electrical heating element and to distribute the heat energy;

a construction layer disposed to one side of the planar heat spreading layer, the construction layer being positioned in direct physical contact with the planar heat spreading layer, the construction layer comprising an installed construction surface that includes at least one of a floor, a roof, a wall or a ceiling layer of a structure;

a thermal isolation layer disposed to an opposite side of the planar heat spreading layer than the construction layer such that heat from the planar heat spreading layer conducts away from the thermal isolation layer toward the construction layer; and an electric power coupling connected to the electrical heating element to supply electrical power.

2. The radiant heating apparatus of claim 1, wherein the planar heat spreading layer comprises a thermally conductive material configured such that thermal conduction is anisotropic, the thermal conduction occurring more readily within a longitudinal plane of the thermally conductive material than perpendicular to the plane of the thermally conductive material.

3. The radiant heating apparatus of claim 2, wherein the laminate graphite sheet is a compressed graphite sheet composed of an exfoliated graphite.

4. The radiant heating apparatus of claim 1, wherein the planar electrical heating element comprises:

a plurality of resistive elements configured to convert electrical energy to heat energy;

a thermal reflection layer configured to reflect heat radiated from the resistive elements back toward the resistive elements;

a first separation layer disposed between the thermal reflection layer and the resistive elements, the first separation layer configured to prevent direct contact between the thermal reflection layer and the resistive elements;

a second separation layer disposed such that the resistive elements are positioned between the first separation layer and the second separation layer, the second separation layer configured to prevent direct contact between the resistive elements and a surface in contact with the planar electrical heating element; and an adhesive disposed between the first separation layer and the second separation layer, the adhesive and separation layers configured to conduct thermal energy from the resistive elements to the planar heat spreading layer by way of the adhesive.

5. The radiant heating apparatus of claim 1, further comprising a covering layer disposed between the planar heat spreading layer and the construction layer, the covering layer configured to further distribute the heat energy and to provide a prepared surface for the constructions layer, the covering layer comprising at least one of concrete, mud, grout, glue or a bonding agent.

6. The radiant heating apparatus of claim 1, wherein the radiant heating apparatus comprises a core radiant heating sheet, and further wherein the electric power coupling is configured to couple the core radiant heating sheet to one or more second radiant heating apparatuses comprising filler radiant heating sheets such that the core radiant heating sheet and the filler radiant heating sheets form a single electric circuit having a standard voltage and current.

7. The radiant heating apparatus of claim 6, wherein the planar electrical heating element is configured to output up to about 8 to 10 watts per foot, and the sum of the lengths of the planar electrical heating elements in the core radiant heating sheet and the filler radiant heating sheets is less than about 269 feet.

8. The radiant heating apparatus of claim 1, wherein the width of the radiant heating apparatus is sized to fit within standard wall stud and ceiling joist spacing widths.

9. The radiant heating apparatus of claim 1, wherein the construction layer is a wall layer and the radiant heating apparatus is disposed within a lower portion of the wall layer, the lower portion extending from a floor to about half of a height of the wall layer.

10. The radiant heating apparatus of claim 1, further comprising a temperature control module, which includes a thermostat, configured to regulate the electrical power supplied to the electrical heating element by the electric power coupling.

11. The radiant heating apparatus of claim 10, wherein the temperature control module comprises a manual switch.

12. The radiant heating apparatus of claim 10, wherein the construction layer is a roofing layer, and the temperature control module comprises a sensor configured to regulate the electrical power supplied to the electrical heating element in response to detecting one of snow and ice accumulation on the roofing layer.

13. The radiant heating apparatus of claim 12, wherein the sensor is a weight sensor.

14. The radiant heating apparatus of claim 12, wherein the sensor is a precipitation and temperature sensor.

15. The radiant heating apparatus of claim 1, wherein the construction layer is a roofing layer and the roofing layer is positioned below the planar heat spreading layer.

16. The radiant heating apparatus of claim 1, wherein the construction layer is composed of at least one of a tile, a stone, a hardwood laminate flooring panel, a carpet, or a linoleum.

17. A portable pliable radiant heating apparatus, comprising:

a pliable planar electrical heating element configured to convert electrical energy to heat energy;

a heat spreading layer that is at least partially in direct contact with the pliable planar electrical heating element and that is configured to draw the heat energy out of the pliable planar electrical heating element and to distribute the heat energy within a longitudinal plane of the pliable planar heat spreading layer the heat spreading layer being composed of a laminate graphite sheet;

a thermal isolation layer positioned below the pliable planar heat spreading layer such that heat from the planar heat spreading layer conducts away from the thermal isolation layer;

a top pliable outer layer and a bottom pliable outer layer joined to enclose the pliable planar heat spreading layer and the thermal isolation layer for durable protection in an outdoor environment, wherein the top pliable outer layer comprises a first side of the top pliable outer layer that is at least partially in direct contact with the thermal isolation layer and a second side of the top pliable outer layer that is exposed and uncovered by any layered structure of the heating apparatus and wherein the bottom pliable outer layer is at least partially in direct contact with the heat spreading layer with a first side of the bottom pliable outer layer, the outer layer including a second side of the bottom pliable outer layer that is also exposed and uncovered by any layered structure of the heating apparatus, such that the second side of the top pliable outer layer and the second side of the bottom pliable outer layer define an outermost shell of the portable pliable radiant heating apparatus; and an electric power coupling connected to the electrical heating element to supply electrical power.

18. The portable pliable radiant heating apparatus of claim 17, further comprising a fastener that is attached to at least one of the top pliable outer layer or the bottom pliable outer layer and that substantially circumscribes a perimeter around the pliable planar heat spreading layer and the thermal isolation layer, and which is configured in size and shape to couple the portable pliable radiant heating apparatus to at least one other object.

19. The portable pliable radiant heating apparatus of claim 17, wherein the heat spreading layer comprises a thermally conductive material is anisotropic, such that thermal conduction occurs more readily within a longitudinal plane of the thermally conductive material than perpendicular to the plane of the thermally conductive material.

20. The portable pliable radiant heating apparatus of claim 17, further comprising a temperature control module, which includes a thermostat, configured to regulate the electrical power supplied to the pliable planar electrical heating element by the electric power coupling.

21. A system for providing radiant heat, comprising:

a core radiant heating sheet configured to provide heat to a portion of a room;

one or more filler radiant heating apparatuses configured to provide heat to smaller portions of the room than the core radiant heating sheet, coupled electrically to the core radiant heating apparatus to form an electric circuit;

wherein the core radiant heating sheet and the filler radiant heating sheets are selected from a set of radiant heating sheets, each radiant heating sheet having a predefined size, each radiant heating sheet comprising:

a pliable multilayered electrical heating element configured to convert electrical energy to heat energy;

a planar carbon-based heat spreading layer, comprising a laminate graphite sheet in direct physical contact with the pliable multilayered electrical heating element and which is configured to draw the heat energy out of the pliable multilayered electrical heating element and to distribute the heat energy; and an electric power coupling connected to the pliable multilayered electrical heating element to supply electrical power;

construction layer disposed to one side of the core radiant heating sheet, at least partially in direct physical contact with the core radiant heating sheet, and the filler radiant heating sheets, the construction layer comprising at least one of a wall, a floor, a roof or a ceiling;

a thermal isolation layer disposed to an opposite side of the core heating sheet and the filler radiant heating sheets as the construction layer such that heat from the core radiant heating sheet and the filler radiant heating sheets conduct heat away from the thermal isolation layer and toward the construction layer;

a power supply configured to supply the core radiant heating sheet and the filler radiant heating sheets with standard electrical power voltages, the electric circuit protected by a standard size electrical breaker; and a temperature control module, which includes a thermostat, configured to regulate the electrical power supplied to the core radiant heating sheet and the filler radiant heating sheets by the power supply.

22. The system for providing radiant heat of claim 21, wherein the construction layer is a wall layer.

23. A radiant heating apparatus, as recited in claim 1, wherein the construction layer is composed of a concrete layer disposed to one side of the planar heat spreading layer and that is in direct contact with the planar heat spreading layer.

24. The portable pliable radiant heating apparatus of claim 17, wherein the top pliable outer layer and the bottom pliable outer layer are composed of a nylon textile.

25. The portable pliable radiant heating apparatus of claim 17, wherein the top pliable outer layer and the bottom pliable outer layer are coated with a waterproof coating.

26. The portable pliable radiant heating apparatus of claim 17, wherein the portable pliable radiant heating apparatus further comprises:

at least a first fastener that forms a circular aperture through at least the top pliable outer layer and the bottom pliable outer layer proximate a first corner of the portable pliable radiant heating apparatus; and at least a second fastener that forms a circular aperture through at least the top pliable outer layer and the bottom pliable outer layer proximate a second corner of the portable pliable radiant heating apparatus, the second corner being a different corner than the first corner of the portable pliable radiant heating apparatus.

* * * * *